US008374877B2

(12) United States Patent
Fusakawa et al.

(10) Patent No.: US 8,374,877 B2
(45) Date of Patent: Feb. 12, 2013

(54) HEARING AID AND HEARING-AID PROCESSING METHOD

(75) Inventors: Kazue Fusakawa, Kanagawa (JP); Gempo Ito, Kanagawa (JP)

(73) Assignee: Panasonic Corporation, Osaka (JP)

( * ) Notice: Subject to any disclaimer, the term of this patent is extended or adjusted under 35 U.S.C. 154(b) by 379 days.

(21) Appl. No.: 12/866,320

(22) PCT Filed: Jan. 28, 2010

(86) PCT No.: PCT/JP2010/000485

§ 371 (c)(1),
(2), (4) Date: Aug. 5, 2010

(87) PCT Pub. No.: WO2010/087171

PCT Pub. Date: Aug. 5, 2010

(65) Prior Publication Data

US 2011/0004468 A1 Jan. 6, 2011

(30) Foreign Application Priority Data

Jan. 29, 2009 (JP) ..... 2009-017549

(51) Int. Cl.
*G10L 21/06* (2006.01)

(52) U.S. Cl. ..... 704/271; 381/23.1; 381/60

(58) Field of Classification Search ..... 704/271; 381/23.1, 60

See application file for complete search history.

(56) References Cited

U.S. PATENT DOCUMENTS

| | | | | |
|---|---|---|---|---|
| 5,572,593 | A * | 11/1996 | Nejime et al. | 381/312 |
| 6,289,310 | B1 * | 9/2001 | Miller et al. | 704/268 |
| 6,732,073 | B1 * | 5/2004 | Kluender et al. | 704/233 |
| 6,971,993 | B2 * | 12/2005 | Fletcher | 600/587 |
| 2005/0222845 | A1 | 10/2005 | Nakagawa et al. | |
| 2007/0058828 | A1 | 3/2007 | Fujii et al. | |
| 2008/0065381 | A1 | 3/2008 | Matsumoto | |
| 2008/0082327 | A1 * | 4/2008 | Murase et al. | 704/234 |

FOREIGN PATENT DOCUMENTS

| | | |
|---|---|---|
| JP | 58-70400 | 4/1983 |
| JP | 59-123400 | 7/1984 |
| JP | 3-245700 | 11/1991 |
| JP | 6-289896 | 10/1994 |
| JP | 10-333695 | 12/1998 |
| JP | 3303446 | 7/2002 |

(Continued)

OTHER PUBLICATIONS

International Search Report issued Apr. 6, 2010 in International (PCT) Application No. PCT/JP2010/000485.

(Continued)

*Primary Examiner* — Jakieda Jackson

(74) *Attorney, Agent, or Firm* — Wenderoth, Lind & Ponack, LLP

(57) ABSTRACT

A hearing aid for improving diminished hearing caused by reduced temporal resolution includes: a speech input unit which receives a speech signal from outside; a speech analysis unit which detects a sound segment and a segment acoustically regarded as soundless from the speech signal received by the speech input unit and detects a consonant segment and a vowel segment within the detected sound segment; and a signal processing unit which temporally increments the consonant segment detected by the speech analysis unit and temporally decrements at least one of the vowel segment and the segment acoustically regarded as soundless detected by the speech analysis unit.

14 Claims, 24 Drawing Sheets

FOREIGN PATENT DOCUMENTS

| | | |
|---|---|---|
| JP | 3596580 | 12/2004 |
| JP | 2005-065124 | 3/2005 |
| JP | 2005-287600 | 10/2005 |
| JP | 2006-087018 | 3/2006 |
| JP | 2007-219188 | 8/2007 |
| JP | 2008-070564 | 3/2008 |

OTHER PUBLICATIONS

B. Franklin, "The Effect of Combining Low- and High-Frequency Passbands on Consonant Recognition in the Hearing Impaired", Journal of Speech and Hearing Research, USA, American Speech-Language-Hearing Association, Dec. 1975, vol. 18, pp. 719-727.

B. Moore, "An Introduction to the Psychology of Hearing", Japanese translation supervised by Ohgushi Kengo, 1994, p. 150-161 (and its original text,. "An Introduction to the Psychology of Hearing", academic press limited., London, 1989, Third edition, pp. 138-149).

R. Takahashi et al., "Evaluation of formant transition expansion of plosives in young normal-hearing listeners in the simulated environment of hearing loss", The Acoustical Society of Japan, Sep. 2009, with partial English Translation from right column, line 28 on p. 595 to left column, line 17 on p. 596.

* cited by examiner

Male "Pa"

Male "Ta"

Male "Ka"

Male "Ba"

Male "Da"

Male "Ga"

Male "Ma"

Male "Na"

Male "Sa"

Male "Za"

Male "Ha"

FIG. 14

| Consonant type | | Temporal resolution |
|---|---|---|
| | | 20 |
| Unvoiced labial stop | p | 1.0 |
| Unvoiced alveolar stop | t | 1.7 |
| Unvoiced velar stop | k | 1.1 |
| Voiced labial stop | b | 4.5 |
| Voiced alveolar stop | d | 4.9 |
| Voiced velar stop | g | 2.7 |
| Unvoiced alveolar fricative | s | 2.0 |
| Unvoiced palatal fricative | sh | 4.8 |
| Voiced alveolar fricative | z | 1.8 |
| Voiced palatal fricative | zh | 1.0 |
| Glottal fricative | h | 1.8 |
| Unvoiced palatal affricate | ch | 1.0 |
| Unvoiced alveolar affricate | ts | 1.0 |
| Labial nasal | m | 1.0 |
| Alveolar nasal | n | 2.4 |
| Flap | l | 2.2 |
| Labial semivowel | w | 1.3 |
| Palatal semivowel (diphthong) | y | 1.0 |

FIG. 15

| Consonant type | | Temporal resolution |
|---|---|---|
| | | 20 |
| Unvoiced stop | p、t、k | ··· |
| Voiced stop | b、d、g | ··· |
| Unvoiced fricative | s、sh | ··· |
| Voiced fricative | z、zh | ··· |
| Unvoiced affricate | ch、ts | ··· |
| Nasal | n、n | ··· |

FIG. 16

| Consonant type | | Minimum temporal resolution |
|---|---|---|
| Unvoiced labial stop | p | (33.5) |
| Unvoiced alveolar stop | t | 11.7 |
| Unvoiced velar stop | k | 17.6 |
| Voiced labial stop | b | 4.4 |
| Voiced alveolar stop | d | 4.1 |
| Voiced velar stop | g | 7.3 |
| Unvoiced alveolar fricative | s | 10.0 |
| Unvoiced palatal fricative | sh | 4.2 |
| Voiced alveolar fricative | z | 11.4 |
| Voiced palatal fricative | zh | 30.1 |
| Glottal fricative | h | 10.9 |
| Unvoiced palatal affricate | ch | (33.5) |
| Unvoiced alveolar affricate | ts | (33.5) |
| Labial nasal | m | 19.3 |
| Alveolar nasal | n | 8.4 |
| Flap | l | 9.2 |
| Labial semivowel | w | 15.1 |
| Palatal semivowel (diphthong) | y | (33.5) |

FIG. 20

| Consonant type | | Temporal resolution | | | | | | | |
|---|---|---|---|---|---|---|---|---|---|
| | | 3 | 5 | 10 | 15 | 20 | 30 | 40 | 50 |
| Unvoiced labial stop | p | 1.0 | 1.0 | 1.0 | 1.0 | 1.0 | 1.0 | 1.0 | 1.0 |
| Unvoiced alveolar stop | t | 1.0 | 1.0 | 1.0 | 1.3 | 1.7 | 2.6 | 3.4 | 4.3 |
| Unvoiced velar stop | k | 1.0 | 1.0 | 1.0 | 1.0 | 1.1 | 1.7 | 2.3 | 2.8 |
| Voiced labial stop | b | 1.0 | 1.1 | 2.3 | 3.4 | 4.5 | 6.8 | 9.1 | 11.4 |
| Voiced alveolar stop | d | 1.0 | 1.2 | 2.4 | 3.7 | 4.9 | 7.3 | 9.8 | 12.2 |
| Voiced velar stop | g | 1.0 | 1.0 | 1.4 | 2.1 | 2.7 | 4.1 | 5.5 | 6.8 |
| Unvoiced alveolar fricative | s | 1.0 | 1.0 | 1.0 | 1.5 | 2.0 | 3.0 | 4.0 | 5.0 |
| Unvoiced palatal fricative | sh | 1.0 | 1.2 | 2.4 | 3.6 | 4.8 | 7.1 | 9.5 | 11.9 |
| Voiced alveolar fricative | z | 1.0 | 1.0 | 1.0 | 1.3 | 1.8 | 2.6 | 3.5 | 4.4 |
| Voiced palatal fricative | zh | 1.0 | 1.0 | 1.0 | 1.0 | 1.0 | 1.0 | 1.3 | 1.7 |
| Glottal fricative | h | 1.0 | 1.0 | 1.0 | 1.4 | 1.8 | 2.8 | 3.7 | 4.6 |
| Unvoiced palatal affricate | ch | 1.0 | 1.0 | 1.0 | 1.0 | 1.0 | 1.0 | 1.0 | 1.0 |
| Unvoiced alveolar affricate | ts | 1.0 | 1.0 | 1.0 | 1.0 | 1.0 | 1.0 | 1.0 | 1.0 |
| Labial nasal | m | 1.0 | 1.0 | 1.0 | 1.0 | 1.0 | 1.6 | 2.1 | 2.6 |
| Alveolar nasal | n | 1.0 | 1.0 | 1.2 | 1.8 | 2.4 | 3.6 | 4.8 | 6.0 |
| Flap | l | 1.0 | 1.0 | 1.1 | 1.6 | 2.2 | 3.3 | 4.3 | 5.4 |
| Labial semivowel | w | 1.0 | 1.0 | 1.0 | 1.0 | 1.3 | 2.0 | 2.6 | 3.3 |
| Palatal semivowel (diphthong) | y | 1.0 | 1.0 | 1.0 | 1.0 | 1.0 | 1.0 | 1.0 | 1.0 |

HEARING AID AND HEARING-AID PROCESSING METHOD

TECHNICAL FIELD

The present invention relates to hearing aids and hearing-aid processing methods and in particular to a hearing-aid processing technique for hearing assistance.

BACKGROUND ART

With the advent of an aging society, there is a growing number of hearing-impaired elderly people. Many of these hearing-impaired elderly people suffer from presbyacusis involved in the aging process. Most of the presbyacusis is so-called sensorineural hearing loss, which is caused by a defect in the inner ear or in the nervous system connected to the inner ear. In other words, the presbyacusis is due to impaired propagation of sound signals caused by weakening, deformation, depletion or such of hair cells in the inner ear, which are supposed to convert the sound signals into signals that are transmitted to the brain, or caused by damage to the nerve that transmit the converted signals to the brain, with aging.

Conventionally, hearing aids have been provided as hearing assistance for hearing-impaired persons with lower-than-normal hearing. The hearing aids use a hearing aid technique that improves hearing by amplifying sound according to an extent of impairment of hearing characteristics of a hearing-impaired person, for example. Recently, speech-rate conversion has also been proposed as a hearing aid technique for improving hearing of words for the elderly, and thus there has appeared not only hearing aids but also a large number of televisions, radios, telephones, etc., with a function of reproducing speech slowly.

However, these hearing-aid appliances using the hearing aid technique merely improve part of mechanisms of hearing impairment. This means that the hearing aids which only amplify sound according to the hearing characteristics will not produce sufficient effects of hearing improvement for hearing-impaired persons with the sensorineural hearing loss including the presbyacusis. This is because the sensorineural hearing loss is not a state where it is difficult to hear simply in terms of sound volume, but is rather characterized by diminished ability for recognizing speech as words.

The characteristic ability impairment due to the sensorineural hearing loss includes 1) Loudness recruitment phenomenon, 2) reduced frequency selectivity, and 3) reduced temporal resolution, which are described in the following.

1) Loudness recruitment phenomenon indicates a phenomenon that a hearing-impaired person has an enhanced minimum audible level than a normal hearing listener, but for the hearing-impaired person, the loudness, which is a sound sensuous volume, rapidly grows when the sound intensity exceeds an audible level. That is, a hearing-impaired person with sensorineural hearing loss tends to be sensitive to changes in sound volume, having difficulty hearing low sounds but feeling sounds even a little higher than the audible level noisy. The above-mentioned conventional hearing aids using the hearing aid technique are intended to improve hearing by focusing on this phenomenon.

2) In the case of the sensorineural hearing loss, the reduced frequency selectivity increases influences of masking of components in different frequency ranges, especially masking of high frequency components by low frequency components (so-called upward spread of masking). That is, hearing-impaired persons with sensorineural hearing loss tend to have more difficulty hearing sounds in the high tone range than sounds in the low tone range. In this regard, some disclosures indicate that separate input of low tones and high tones to right and left ears improves speech intelligibility (refer to Non-Patent Literature 1, for example).

3) In the case of the sensorineural hearing loss, the reduced temporal resolution makes it difficult to respond to rapid sound changes. This therefore increases influences of temporal masking that one sound is masked by the other sound when two sounds are successively given, for example. That is, a hearing-impaired person with sensorineural hearing loss has difficulty in perceiving rapidly-changing sounds or in distinguishing temporally-close sounds. The temporal masking includes two types: forward masking, in which a preceding sound masks the following sound, and backward masking, in which a preceding sound is masked by the following sound. The forward masking indicates a phenomenon that when a person responds to a certain sound, the response to that sound will not be settled down soon after the loss of the sound, with the result that the following sound generated during the period becomes hard to hear. The backward masking indicates a phenomenon that because the neural response is quicker to louder sounds, a loud sound coming after a soft sound makes these two sounds indistinguishable from each other, with the result that the preceding soft sound becomes hard to hear.

In an ordinary conversation, vowels are characterized by high energy, small temporal changes, and long duration, while consonants are characterized by low energy, rapid changes, and short duration. Accordingly, although depending on a speaking speed in a conversation, a hearing-impaired person with sensorineural hearing loss often finds it difficult to hear consonants because they are prone to temporal masking by vowels before and after them.

Furthermore, a hearing-impaired person with sensorineural hearing loss who has difficulty responding to rapid sound changes because of reduced temporal resolution often misses a consonant even with no temporal masking by sounds before and after the consonant. This is because consonants, which rapidly change with short duration, are lost before hair cells of the hearing-impaired person with sensorineural hearing loss respond, and the hearing-impaired person is therefore not able to respond to such consonants. As a result, the hearing-impaired person misses the consonants.

As above, hearing-impaired persons with sensorineural hearing loss find it difficult to hear consonants because of the reduced temporal resolution and therefore are unable to know what is told or hear wrong, which decreases the consonant recognition ratio.

To deal with this, there is conventionally a method of reducing influences of the temporal masking. For example, there is a disclosed technique that, in order to prevent a vowel from temporally masking a consonant, signals of the vowel in low-frequency band with high formant components are suppressed, thereby emphasizing the consonant (refer to Patent Literature 1, for example). Another disclosed technique is that between a vowel and a consonant, a soundless segment is provided by suppressing part of a tail part of the vowel for a specific time, thereby reducing influences of temporal masking on an incoming consonant (refer to Patent Literatures 2 and 3, for example). There is still another proposed technique that provides right and left ears with respective signals having different frequency characteristics in order to reduce masking which relates to the temporal masking of a consonant by a vowel and occurs between frequency components (refer to Patent Literature 4, for example).

These processing can reduce the temporal masking of a consonant by a vowel and thereby improve hearing of consonants.

CITATION LIST

Patent Literature

[PTL 1]
Japanese Patent No. 3596580
[PTL 2]
Japanese Patent No. 3303446
[PTL 3]
Japanese Unexamined Patent Application Publication No. 3-245700
[PTL 4]
Japanese Unexamined Patent Application Publication No. 2006-87018
[PTL 5]
Japanese Unexamined Patent Application Publication No. 58-70400

Non Patent Literature

[NPL 1]
Barbara Franklin, "The Effect of Combing Low- and High-Frequency Passbands on Consonant Recognition in the Hearing Impaired", Journal of Speech and Hearing Research, USA, American Speech-Language-Hearing Association, December 1975, Vol. 18, 719-727.

SUMMARY OF INVENTION

Technical Problem

However, the above conventional technique merely enables reduction in the temporal masking of a consonant by a vowel, which is one of the influences of reduced temporal resolution. In other words, the above conventional techniques do not contribute to the improvement of consonant recognition ratio which allows a hearing-impaired person with sensorineural hearing loss to perceive consonants that rapidly change with short duration.

Furthermore, the conventional speech-rate conversion lowers the speech rate by temporal increment in a manner that, with use of steady part (mainly, vowel part) of speech, a pitch cycle is extracted to perform interpolation in units of pitch. It therefore has not achieved the improvement of the consonant recognition ratio achieved through perception of consonants that rapidly change with short duration. Rather, the lowered speech rate causes a state of so-called no lip synchronization in which visual information and auditory information no longer synchronize with each other because of a lag between lip movement and voice, which may result in more difficulty in listening to the conversation.

The present invention is therefore intended to solve these problems caused by reduced temporal resolution, and an object of the present invention is to provide a hearing aid and a hearing-aid processing method which improve the recognition ratio of consonants that rapidly change with short duration.

Solution to Problem

In order to solve the above problems, the hearing aid according to an aspect of the present invention includes: a speech input unit configured to receive a speech signal from outside; a speech analysis unit configured to detect a sound segment and a segment acoustically regarded as soundless from the speech signal received by the speech input unit, and to detect a consonant segment and a vowel segment within the detected sound segment; and a signal processing unit configured to temporally increment the consonant segment detected by the speech analysis unit and to temporally decrement at least one of the vowel segment and the segment acoustically regarded as soundless detected by the speech analysis unit.

With this configuration, the consonant segment is temporally incremented to improve the recognition ratio of consonants that rapidly change with short duration and at the same time, a vowel segment or a segment acoustically regarded as soundless is decremented so that visual information and auditory information are synchronized with each other, with the result that the hearing assistance of lip synchronization can be maintained.

Furthermore, the vowel segment may be temporally decremented by removing the speech signal in units of pitch from the vowel segment for part of the amount of time by which the consonant segment is incremented, and the segment acoustically regarded as soundless may be temporally decremented by removing the speech signal from the segment acoustically regarded as soundless for a remaining part of the amount of time by which the consonant segment is incremented.

With this configuration, not the consonant segment itself (position/location) but part of time (amount) incremented by the increment processing is removed from a vowel segment to avoid the state of no lip synchronization. This makes it possible to improve the recognition ratio of consonants that rapidly change with short duration, and prevent such deterioration in sound quality as change in tone pitch while keeping the hearing assistance of lip synchronization.

Furthermore, the hearing aid may further include an adjustment unit configured to adjust an amount of time by which the consonant segment is to be incremented, based on temporal resolution information that indicates auditory temporal resolution of a user of the hearing aid, and the signal processing unit may be configured to increment, by the amount of time adjusted by the adjustment unit, the consonant segment detected by the speech analysis unit.

With this configuration, it is possible to improve hearing of consonants suitably for an individual hearing aid user.

Furthermore, the hearing aid may further include an adjustment unit configured to calculate sound pressure of the speech signal and to adjust, based on the calculated sound pressure, the amount of time by which the consonant segment is to be incremented, and the signal processing unit may be configured to increment, by the amount of time adjusted by the adjustment unit, the consonant segment detected by the speech analysis unit.

With this configuration, it is possible to improve speech intelligibility according to sound pressure of input speech.

Furthermore, the speech analysis unit may be configured to analyze a type of a consonant in the consonant segment, the hearing aid may further include an adjustment unit configured to adjust the amount of time by which the consonant segment is to be incremented, based on the type of the consonant analyzed by the speech analysis unit, and the signal processing unit may be configured to increment, by the amount of time adjusted by the adjustment unit, the consonant segment detected by the speech analysis unit.

With this configuration, it is possible to provide the most appropriate length of time for each consonant according to its consonant type and thus improve the speech intelligibility according to each consonant.

Advantageous Effects of Invention

According to the present invention, it is possible to provide a hearing aid and a hearing-aid processing method which improve the recognition ratio of consonants that rapidly change with short duration. To be specific, the present invention allows hearing-impaired persons with the sensorineural hearing loss including the presbyacusis who has reduced temporal resolution to improve hearing, especially, of consonants, and thus enables improved speech intelligibility.

BRIEF DESCRIPTION OF DRAWINGS

FIG. 14 shows one example of an increment ratio table.

FIG. 15 shows one example of an increment ratio table.

FIG. 16 shows one example of a minimum temporal resolution table.

FIG. 20 shows one example of an increment ratio table.

DESCRIPTION OF EMBODIMENTS

Hereinafter, embodiments of the present invention shall be described with reference to the drawings.

First Embodiment

Figure 1:
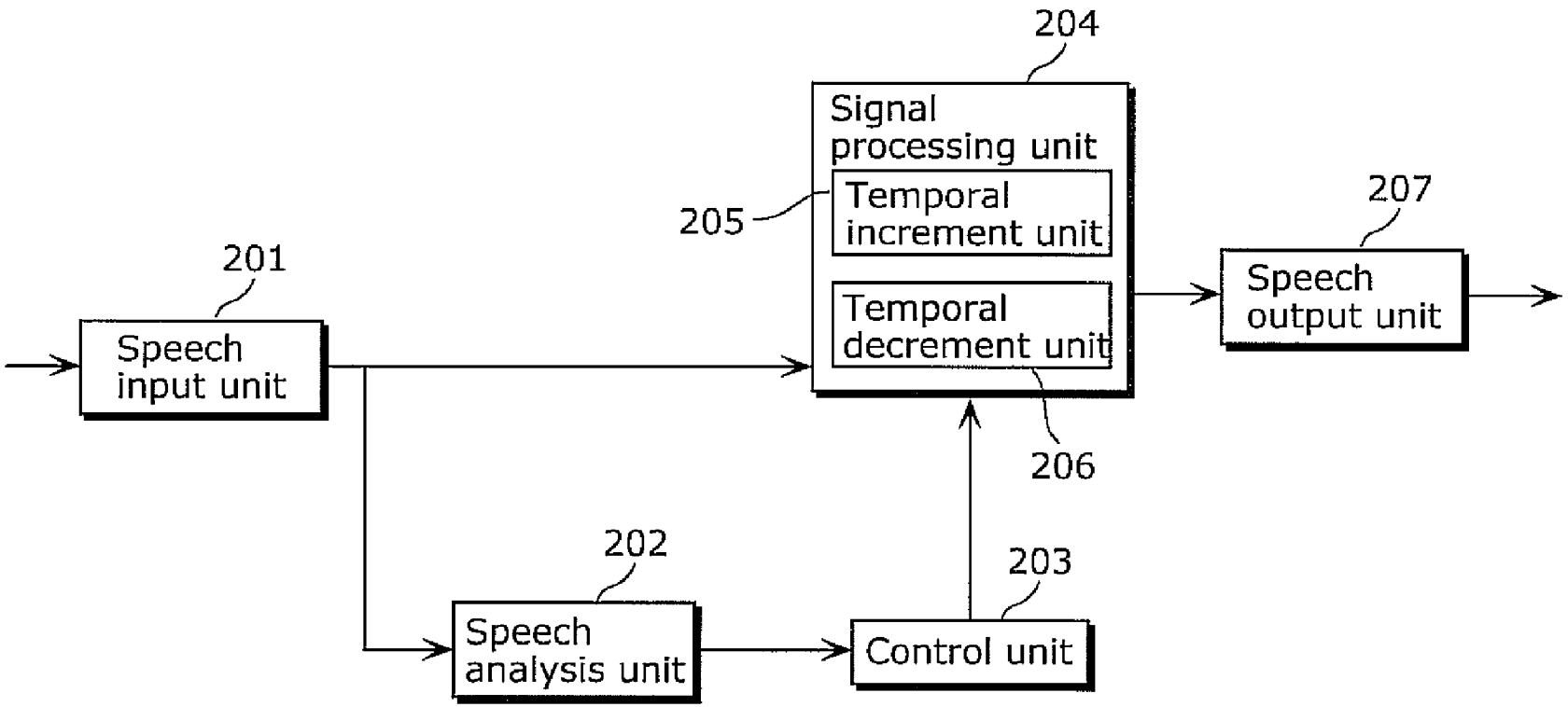
FIG. 1 is a block diagram showing a configuration of a hearing aid according to the first embodiment of the present invention.

FIG. 1 is a block diagram showing a configuration of a hearing aid according to the first embodiment of the present invention.

The hearing aid shown in FIG. 1 includes a speech input unit 201, a speech analysis unit 202, a control unit 203, a signal processing unit 204, and a speech output unit 207.

The speech input unit 201 is, for example, a microphone, an induction coil, or an external input terminal which receives output of a speech communication device or a speech reproduction device, and receives a speech signal from outside and outputs the received speech signal to the signal processing unit 204.

The speech analysis unit 202 analyzes the speech signal which the speech input unit 201 receives, for a sound type (such as a vowel, a consonant, or the other). Specifically, the speech analysis unit 202 determines whether the received speech signal is a segment acoustically regarded as soundless or a sound segment. Furthermore, the speech analysis unit 202 detects a consonant segment and a vowel segment subsequent to the consonant segment within the sound segment determined as a sound segment, thereby determining a consonant segment and a vowel segment.

For example, the speech analysis unit 202 determines the segment acoustically regarded as soundless and the sound segment as follows. The speech analysis unit 202 calculates power of a speech signal per unit time and when a time required for the power to become equal to or above a predetermined threshold exceeds predetermined duration, the speech analysis unit 202 determines that the speech signal is a sound segment, and when the time is shorter than the predetermined duration and when the power is smaller than the predetermined threshold, the speech analysis unit 202 determines that the speech signal is a segment acoustically regarded as soundless. As a method of determining the sound segment and the segment acoustically regarded as soundless (soundless segment), any known determination methods other than the exemplified method may be used.

For example, in the following manner, the speech analysis unit 202 detects and determines a consonant segment and a vowel segment within the sound segment determined as a sound segment. The speech analysis unit 202 uses, for example, a method of extracting (detecting) formant frequencies or a pitch cycle within the sound segment determined as a sound segment, and determining a consonant and a vowel based on the respective characteristics of consonants and vowels. It is difficult to distinguish a consonant alone from other noise and therefore, in order to determine a consonant segment, existence of a subsequent vowel is used to predict and determine a consonant segment. It is to be noted that the speech analysis unit 202 may determine the consonant segment and the vowel segment based on either the formant frequencies or the pitch cycle and may use any known methods other than the above exemplified method.

The control unit 203 controls the signal processing unit 204 based on the analysis conducted by the speech analysis unit 202. In other words, on the basis of the sound type (such as a vowel, a consonant, or the other) analyzed by the speech analysis unit 202, the control unit 203 determines which processing (such as increment or decrement) is to be done on that sound. The control unit 203 transmits to the signal processing unit 204 a control signal containing information such as a segment and a processing detail of the sound to control the signal processing unit 204.

To be specific, when a consonant segment or a vowel segment subsequent to the consonant segment is detected by the speech analysis unit 202, the control unit 203 controls the signal processing unit 204 according to the detected consonant segment or the detected vowel segment subsequent to the consonant segment. In the case where a consonant segment is detected by the speech analysis unit 202, the control unit 203 inputs to the signal processing unit 204 a control signal containing information that is used for a temporal increment of the consonant segment by a temporal increment unit 205. Furthermore, in the case where the consonant segment detected by the speech analysis unit 202 is followed by a vowel segment, the control unit 203 inputs to the control processing unit 204 a control signal containing information that is used for temporal decrement of the vowel segment by a temporal decrement unit 206.

Allocation of the processing between the control unit 203 and the signal processing unit 204 can vary depending on how to implement them and is thus not limited to the processing allocation according to the present embodiment. For example, it is possible to employ a configuration that the control unit 203 transmits only the sound type and the processing detail to the signal processing unit 204 and the processing time is determined by the signal processing unit 204 and, as necessary, transmitted to the control unit 203.

In addition, the information that is used for a temporal increment of the consonant segment by the temporal increment unit 205 may either be determined for each of the types of the detected consonant or be determined for each of the consonant groups into which the consonants are roughly classified. Furthermore, that information may be determined for each of the consonant types or each of the roughly classified consonant groups, according to the temporal resolution of a user.

The signal processing unit 204 has the temporal increment unit 205 and the temporal decrement unit 206, and according to the control signal from the control unit 203, the signal processing unit 204 uses the temporal increment unit 205 and the temporal decrement unit 206 to perform signal processing on a speech signal output from the speech input unit 201. To be specific, the signal processing unit 204 receives a speech signal from the speech input unit 201 and receives a control signal from the control unit 203. According to the control signal from the control unit 203, the signal processing unit 204 uses the temporal increment unit 205 and the temporal decrement unit 206 to process the speech signal received from the speech input unit 201. To be more specific, the signal processing unit 204 temporally increments the consonant segment detected by the speech analysis unit 202 and temporally decrements at least one of the vowel segment and the segment acoustically regarded as soundless, which segments are detected by the speech analysis unit 202. In the case where, in order to determine a consonant, the speech analysis unit 202 needs to receive a subsequent vowel, the control signal from the control unit 203 will be delayed in determination of the consonant segment. It is therefore necessary in general to provide a delay buffer within the signal processing unit 204 or in a stage prior to the signal processing unit 204 so that the temporal decrement and decrement units can operate according to the delay in determination.

The temporal increment unit 205 temporally increments the consonant segment designated by the control signal from the control unit 203. The temporal increment of the consonant segment can be achieved by such a technique as temporally extracting the speech signal in the consonant segment and repeating the extracted part, for example, as disclosed in Patent literature 5. Furthermore, by performing a cross fade including fade-in and fade-out in the temporal increment of the consonant segment, it is possible to make adjacent segments more smooth and seamless.

Thus, an increase in a time (consonant segment) in which a consonant is sounding will enable even diminished hair cells in the inner ear to respond to the consonant and moreover will allow for a reduction in influences of temporal masking of a consonant by the vowels prior and subsequent to the consonant. This makes it possible to improve a consonant recognition ratio of a hearing-impaired person who has difficulty in hearing consonants. It is to be noted that a method of incrementing the consonant segment is not limited to the above consonant increment method and other consonant increment methods may also be used. Even in such a case, the recognition ratio improves as in the above case.

The temporal decrement unit 206 decrements at least one of the vowel segment and the segment acoustically regarded as soundless, by an amount of increment time of the consonant segment. To be specific, according to the control signal from the control unit 203, the temporal decrement unit 206 temporally decrements the vowel segment subsequent to the above designated consonant segment or the segment acoustically regarded as soundless or temporally decrements both of the vowel segment subsequent to the above designated consonant segment and the segment acoustically regarded as soundless. The temporal decrement unit 206 temporally decrements the vowel segment by removing the speech signal in units of pitch from the vowel segment for part of the increment time of the consonant segment, and temporally decrements the segment acoustically regarded as soundless by removing signals from the segment acoustically regarded as soundless for the remaining part of the increment time of the consonant segment. Thus, the temporal decrement unit 206 does not process the consonant segment itself (position/location) but takes a measure of temporally decrementing the subsequent segment by an increase in time (amount) which results from the increment processing, that is, by an amount of increment time of the consonant segment. This makes it possible, even when the temporal increment unit 205 temporally increments the consonant segment, to address the problem of disabled hearing assistance of lip synchronization (synchronization between visual perception and auditory perception) due to a lag between visual information and auditory information.

To be more specific, the temporal decrement unit 206 performs the temporal decrement processing by removing part of the speech signals from the subsequent vowel segment or part or all of the speech signals from the soundless segment for an amount of time equal to or more than the amount of increment time of the consonant segment based on its record or the like so that timing of generating the consonant matches the visual information. This is because removing part of the sound from the vowel segment will not make the vowel hard to hear because the vowel has long sound duration and is kept in a steady state. Likewise, removing part or all of the signals of the soundless segment does not cause negative impacts on hearing of the speech. However, even in this case, in order to prevent such deterioration of sound quality as a change in tone pitch caused by the temporal decrement of the vowel segment, it is preferable to decease the time by extracting the pitch cycle of the vowel in the vowel segment to be decremented and then removing the speech signal in units of pitch. In the case of removing the speech signal in units of pitch from the vowel segment, the length of time for removed signals would not exactly match the length of increment time of the consonant. However, even with this case, when part of the signals of the vowel segment is to be removed, it is still desirable to remove the speech signal in units of pitch for the above-described reasons although the length of time for removed segment does not exactly match the length of increment time.

The increment time of the consonant may be held by either the control unit 203 or the signal processing unit 204. In addition, it is also possible to employ a configuration in which another recording unit is provided to record the increment time.

The speech output unit 207 outputs a speech signal processed by the signal processing unit 204. The speech output unit 207 includes, for example, not only an earphone, a speaker, a headphone, and the like, but also other devices using a transducer such as a bone-conduction transducer, an inner ear electrode, and the like.

Figure 2:
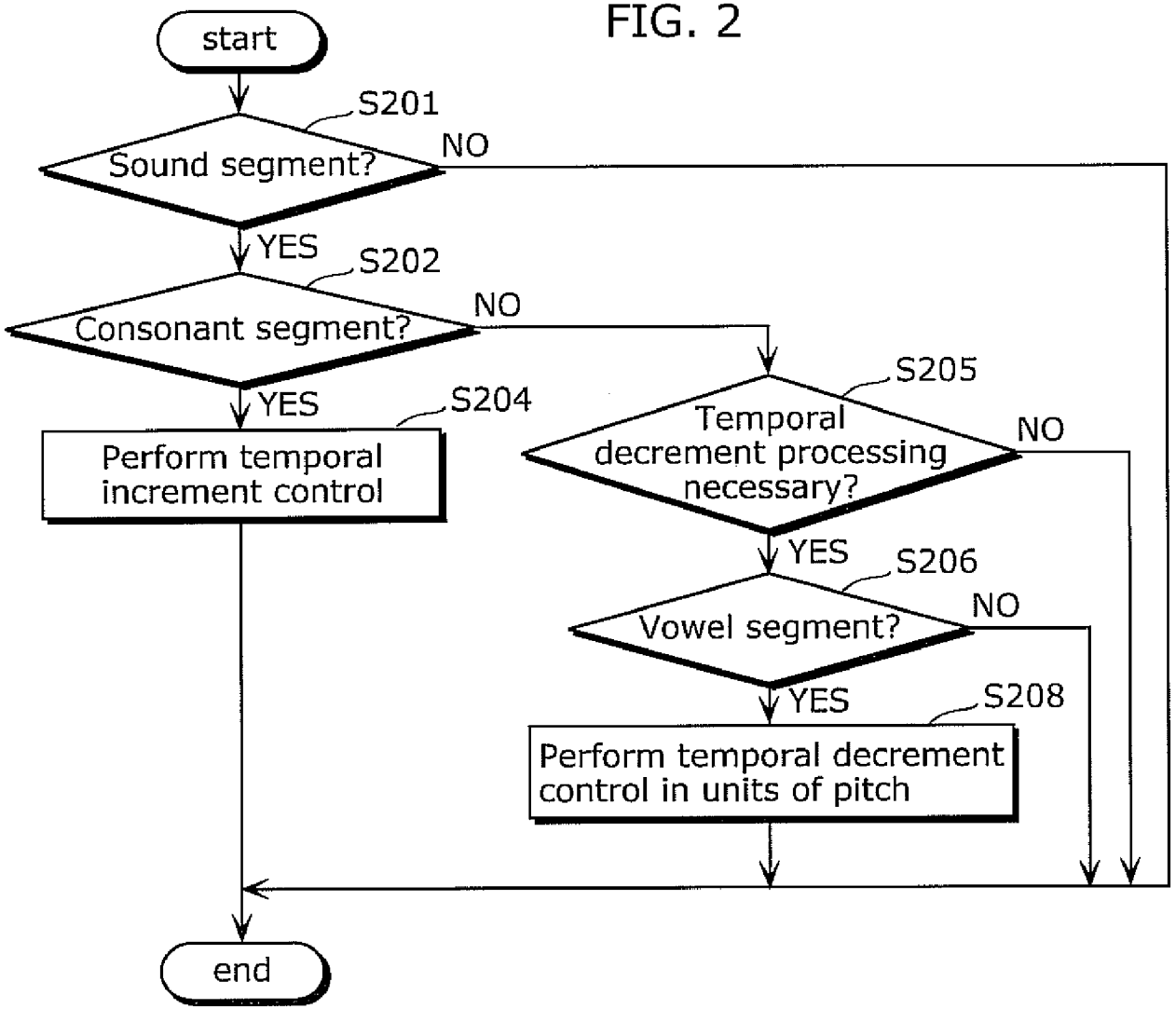
FIG. 2 is a flowchart showing the first operation example of a speech analysis unit and a control unit according to the first embodiment of the present invention.

The following shall describe one example of the speech analysis unit 202 and the control unit 203 in the hearing aid according to the present embodiment configured as above. FIG. 2 is a flowchart showing the first operation example of the speech analysis unit and the control unit according to the first embodiment. The following first operation example shows the case where a consonant detection flag "cons" is used.

The speech analysis unit 202, first, determines whether or not the input speech received by the speech input unit 201 is a sound segment (S201). When the speech analysis unit 202 determines that the input speech is a sound segment (YES in S201), the process proceeds to a step (S202) of determining whether or not the determined sound segment is a consonant segment. When the speech analysis unit 202 determines that the input speech is not a sound segment (NO in S201), the process ends.

Next, when the speech analysis unit 202 determines in Step S202 that speech of the sound segment is speech of a consonant segment (YES in Step S202), the process proceeds to a step (S204) of performing a temporal increment control. When the speech analysis unit 202 determines that the speech of the sound segment is not speech of a consonant segment (NO in Step S202), the process proceeds to a step (S205) of determining whether or not the temporal decrement processing is necessary. In Step S204, the control unit 203 controls the temporal increment unit 205 of the signal processing unit 204 to perform the temporal increment by a predetermined amount of time and assigns 1 to the consonant detection flag "cons".

On the other hand, when the speech analysis unit 202 determines in Step S202 that the sound segment is not a consonant segment (NO in S202), the process proceeds to a step (S205) of determining whether or not the temporal decrement processing is necessary. When the speech analysis unit 202 determines in Step S205 that the consonant detection flag "cons" is 1 (YES in S205), the process further proceeds to a step (S206) of determining whether or not the sound segment is a vowel segment. When the speech analysis unit 202 determines that the consonant detection flag "cons" is not 1 (NO in S205), the process ends. When the speech analysis unit 202 determines in Step S206 that the sound segment is a vowel segment (YES in S206), the process proceeds to a step (S208) of performing a temporal decrement control in units of pitch. When the speech analysis unit 202 determines that the sound segment is not a vowel segment (NO in S206), the process ends. In Step S208, the control unit 203 controls the temporal decrement unit 206 to perform the temporal decrement by removing the speech signal in units of pitch from the vowel segment by an amount of time equal to or more than the increment time of the consonant, and assigns 0 to the consonant detection flag "cons".

As above, the speech analysis unit 202 and the control unit 203 sequentially operate for the input speech received by the speech input unit 201. It is to be noted that the reason for determining in S205 whether or not the consonant detection flag "cons" is 1 is to prevent unnecessary temporal decrements in the case where no temporal increment has been made or in the case where a temporal decrement has been made after a temporal increment (in both cases, "cons" is 0). Furthermore, NO in S206 is provided to deal with the case where the sound segment is neither the consonant segment nor the vowel segment but is noise or the like.

In addition, to use an increment time variable "dur" instead of the consonant detection flag "cons" in the above first operation example, the operation is as follows. That is, in Step S204, instead of assigning 1 to "cons", the increment time of the consonant is added to "dur". In Step S205, instead of determining whether or not "cons" is 1, it is determined whether or not "dur" is larger than 0. In Step S208, the control unit 203 controls the temporal decrement unit to perform the temporal decrement within the range of the time indicated by "dur", and subtracts the amount of decrement time of the vowel from the variable "dur". Such a process using the increment time variable "dur" is effective particularly in the case where the hearing aid according to an implementation of the present invention executes processing by dividing input speech into short time intervals, like frame processing. Furthermore, the method is not limited to the above-described method using the consonant detection flag or the increment time variable, and it is possible to use other methods in which it can be determined whether or not the increment processing is to be performed.

Figure 3:
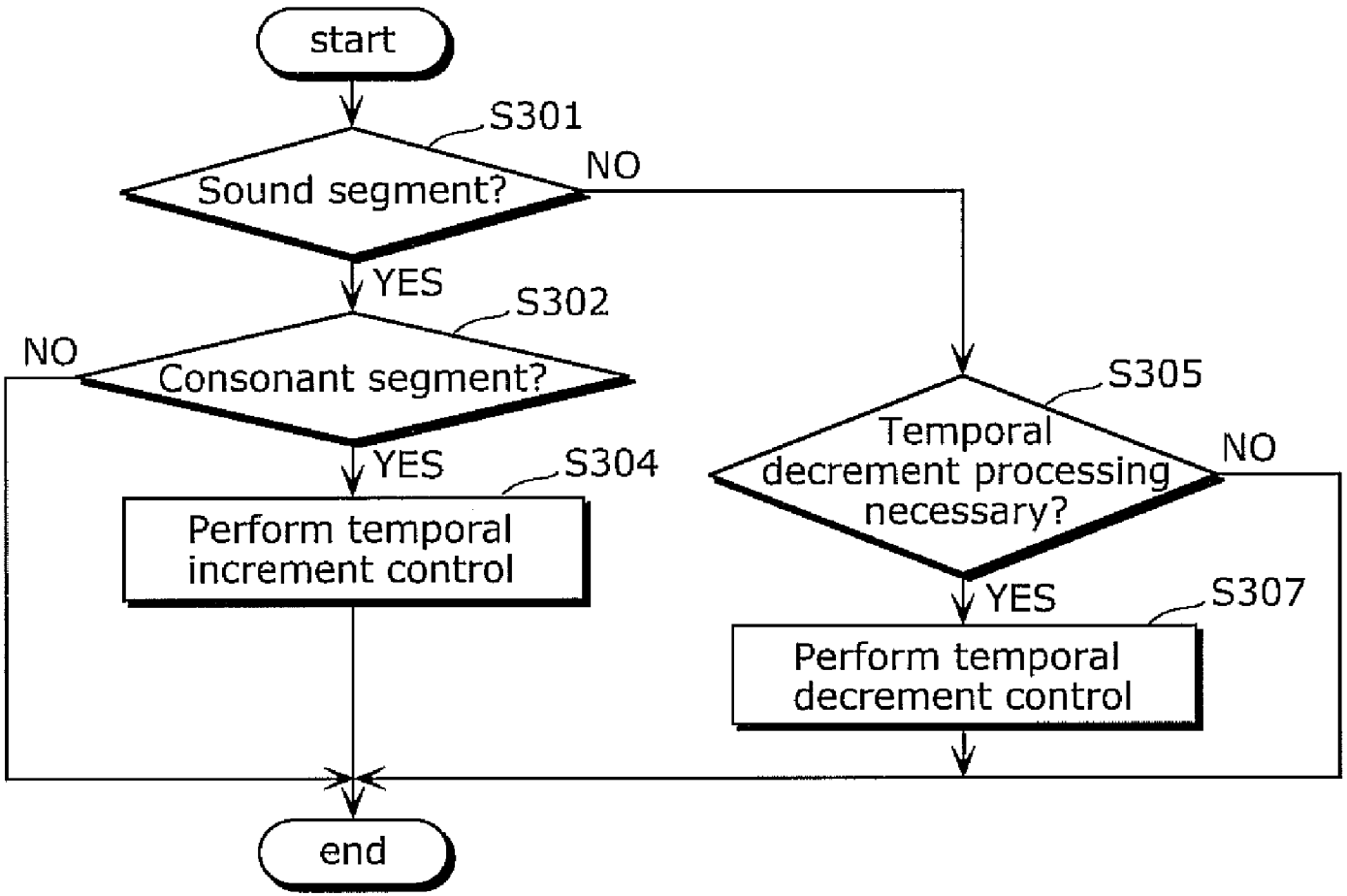
FIG. 3 is a flowchart showing the second operation example of the speech analysis unit and the control unit according to the first embodiment of the present invention.

Next, another operation example (the second operation example) of the speech analysis unit 202 and the control unit 203 is described. FIG. 3 is a flowchart showing the second operation example of the speech analysis unit and the control unit according to the first embodiment. While the following second operation example also shows the case where the consonant detection flag "cons" is used, it is possible to use, as in the case of the above first operation example, other methods in which the increment time variable "dur" is used or in which it can be determined whether or not the increment processing is to be performed.

The speech analysis unit 202, first, determines whether or not the input speech received by the speech input unit 201 is a sound segment (S301). When the speech analysis unit 202 determines that the input speech is a sound segment (YES in S301), the process proceeds to a step (S302) of determining whether or not the determined sound segment is a consonant segment. When the speech analysis unit 202 determines that the input speech is not a sound segment (NO in S301), the process proceeds to a step (S305) of determining whether or not the temporal decrement processing is necessary.

Next, when the speech analysis unit 202 determines in S302 that speech of the sound segment is speech of a consonant segment (YES in Step S302), the process proceeds to a step (S304) of performing a temporal increment control. When the speech analysis unit 202 determines that the speech of the sound segment is not speech of a consonant segment (NO in Step S302), the process ends. The operation in Step S304 is not described here because it is the same as Step S204 in FIG. 2.

On the other hand, when the speech analysis unit 202 determines in Step S305 that the consonant detection flag "cons" is 1 (YES in S305), the process proceeds to a step (S307) of performing a temporal decrement control. When the speech analysis unit 202 determines that the consonant detection flag "cons" is not 1 (NO in S305), the process ends. In Step S307, the control unit 203 controls the temporal decrement unit 206 to perform the temporal decrement by removing the speech signal in units of pitch from the segment acoustically regarded as soundless by an amount of time equal to or more than the increment time of the consonant, and assigns 0 to the consonant detection flag "cons".

As above, the speech analysis unit 202 and the control unit 203 sequentially operate for the input speech received by the speech input unit 201. It is to be noted that a difference between the first operation example and the second operation example is that the temporal decrement is performed by removing signals not from the vowel segment but from the segment acoustically regarded as soundless.

Figure 4:
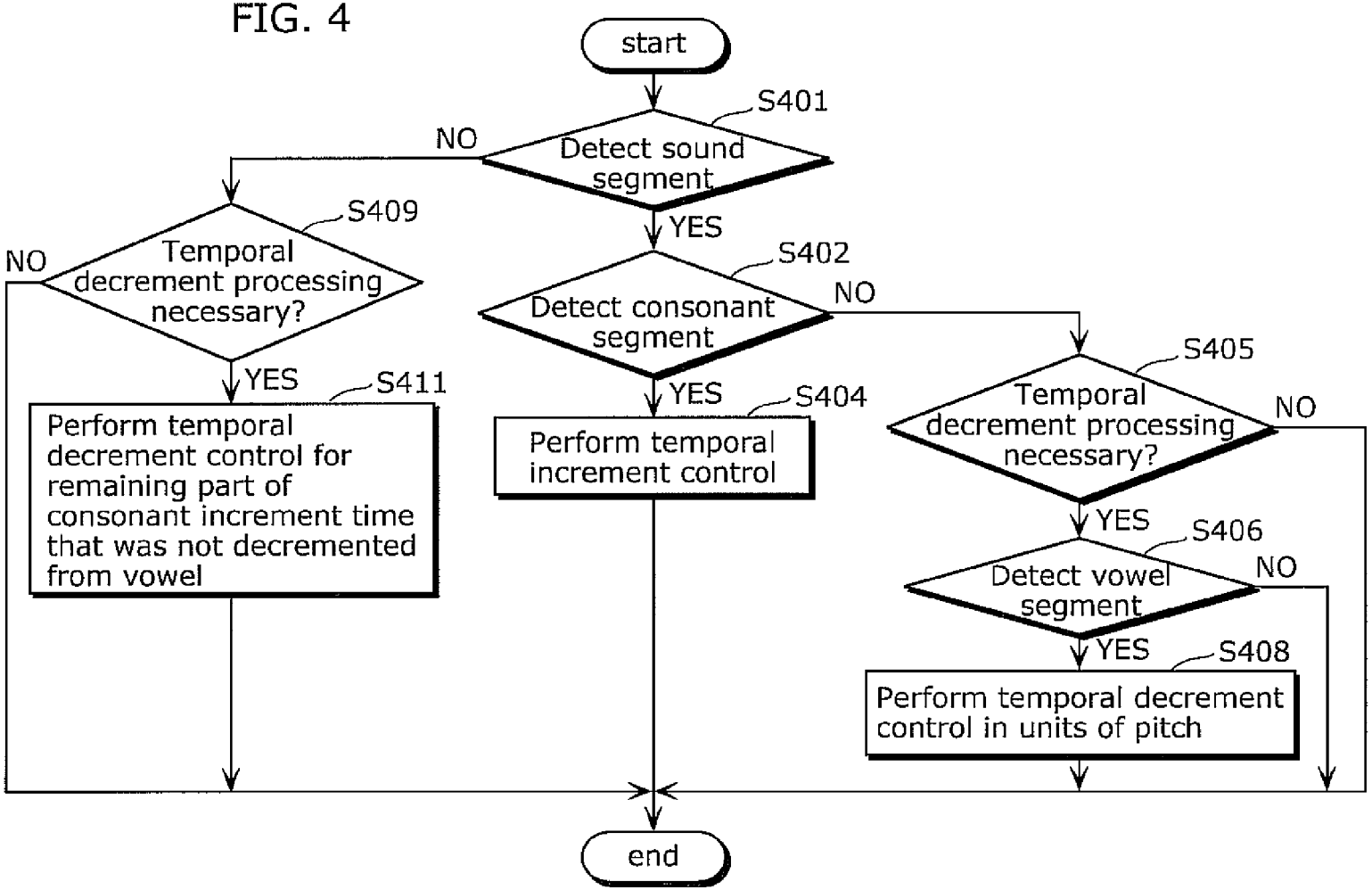
FIG. 4 is a flowchart showing the third operation example of the speech analysis unit and the control unit according to the first embodiment of the present invention.

Next, another operation example (the third operation example) of the speech analysis unit 202 and the control unit 203 is described. FIG. 4 is a flowchart showing the third operation example of the speech analysis unit 202 and the control unit 203 according to the first embodiment. While the following third operation example also shows the case where the consonant detection flag "cons" is used, it is possible to use, as in the case of the above first or second operation example, other methods in which the increment time variable "dur" is used or in which it can be determined whether or not the increment processing is to be performed.

The speech analysis unit 202, first, determines whether or not the input speech received by the speech input unit 201 is a sound segment (S401). When the speech analysis unit 202 determines that the input speech is a sound segment (YES in S401), the process proceeds to a step (S402) of determining whether or not the determined sound segment is a consonant segment. When the speech analysis unit 202 determines that the input speech is not a sound segment (NO in S401), the process proceeds to a step (S409) of determining whether or not the temporal decrement processing is necessary.

When the speech analysis unit 202 determines in S402 that speech of the sound segment is speech of a consonant segment (YES in Step S402), the process proceeds to a step (S404) of performing a temporal increment control. When the speech analysis unit 202 determines that speech of the sound segment is not speech of a consonant segment (NO in S402), the process proceeds to a step (S405) of determining whether or not the temporal decrement processing is necessary. The operation from Step S404 to Step S406 is not described here because it is the same as the operation from Step S204 to Step S206 in FIG. 2.

When the speech analysis unit 202 determines (detects) in Step S406 that the sound segment is a vowel segment (YES in S406), the process proceeds to a step (S408) of performing a temporal decrement control in units of pitch. When the speech analysis unit 202 determines (detects) that the sound segment is not a vowel segment (NO in S406), the process ends. In Step S408, the control unit 203 controls the temporal decrement unit 206 to perform the temporal decrement by removing the speech signal in units of pitch from the vowel segment by an amount of time equal to or less than the increment time of the consonant. Then, when the sum of the amount of decrement time of the vowel segment and the amount of decrement time of the segment acoustically regarded as soundless is equal to the amount of increment time of the consonant, the control unit 203 assigns 0 to the consonant detection flag "cons".

On the other hand, when the speech analysis unit 202 determines in Step S409 that the consonant detection flag "cons" is 1 (YES in S409), the process proceeds to a step (S411) of performing a temporal decrement control. When the speech analysis unit 202 determines that the consonant detection flag "cons" is not 1 (NO in S409), the process ends. In Step S411, the control unit 203 controls the temporal decrement unit 206 to perform the temporal decrement by removing signals from the segment acoustically regarded as soundless by an amount of time equal to or less than the increment time of the consonant. Then, when the sum of the decrement time of the vowel segment and the decrement time of the segment acoustically regarded as soundless is equal to the increment time of the consonant, the control unit 203 assigns 0 to the consonant detection flag "cons".

As above, the speech analysis unit 202 and the control unit 203 sequentially operate for the input speech received by the speech input unit 201. It is to be noted that a difference between the first operation example and the second operation example is that the temporal decrement is performed by removing signals from the vowel segment and from the segment acoustically regarded as soundless.

While the temporal decrement control is performed on either the vowel segment or the segment acoustically regarded as soundless which is detected first in the above third operation example, the operation may be as follows using not only the consonant determination flag "cons" but also a vowel determination flag vow when the vowel segment is to be detected before the temporal decrement processing is performed on the segment acoustically regarded as soundless. That is, in Step S408, the control unit 203 controls the temporal decrement unit 206 to perform the temporal decrement by removing the speech signal in units of pitch from the vowel segment by an amount of time less than the increment time of the consonant, and assigns 0 to "cons" and in addition, assigns 1 to vow. When it is determined in Step S409 that "cons" is 0 and vow is 1, the process proceeds to S401. In Step 411, signals are removed from the segment acoustically regarded as soundless for a difference in time between the increment time of the consonant and the decrement time of the vowel (for example, for a remaining part of the increment time of the consonant that was not decremented from the vowel segment), and 0 is assigned to vow.

As above, in the present embodiment, the temporal decrement processing is performed using a subsequent vowel segment, a subsequent segment acoustically regarded as soundless, or both of the subsequent vowel segment and the subsequent segment acoustically regarded as soundless. However, the temporal decrement processing may be performed on not only the above-explained segments but also another vowel segment which is subsequent to the above subsequent vowel segment or another segment of noise or the like. In any of these cases, what is necessary is to take a measure to perform the temporal decrement using a segment appropriate for the speech signal so as to solve lag between visual information and auditory information and thereby allow for hearing assistance of lip synchronization.

As above, in this first embodiment, it is possible to provide a hearing aid and a hearing-aid processing method which improve the recognition ratio of consonants that rapidly change with short duration. To be specific, the speech signal received by the speech input unit 201 is analyzed by the speech analysis unit 202, it is determined whether the input speech is a segment acoustically regarded as soundless or a sound segment, and it is further determined whether the input speech of the determined sound segment is a consonant segment or a vowel segment. According to the determination result from the speech analysis unit 202, the control unit 203 outputs a control signal to the signal processing unit 204 to operate the temporal increment unit 205 and the temporal decrement unit 206 of the signal processing unit 204. In the temporal increment unit 205, the consonant segment is temporally incremented, and in the temporal decrement unit 206, the temporal decrement is performed by removing signals, by an amount of increment time of the consonant segment, from a subsequent vowel segment, a subsequent segment acoustically regarded as soundless, or both of the subsequent vowel segment and the subsequent segment acoustically regarded as soundless.

Such a temporal increment of a consonant segment to a perceptible level is able to give a time to percept a consonant for a hearing-impaired person who has reduced temporal resolution and thus difficulty in hearing consonants of speech in ordinary conversations, resulting in improved recognition of whole speech. Moreover, as to the problem of losing hearing assistance of lip synchronization due to a consonant increment, the lag between visual information and auditory information can be solved by temporally decrementing a subsequent vowel segment, a segment acoustically regarded as soundless, another vowel segment, a meaningless segment, or the like.

The temporal increment of a consonant segment may be performed using a method of simply and quickly detecting characteristics of speech to be incremented, without analyzing whole consonants. In this case, not only the above-mentioned delay in determination of the consonant segment can be reduced, but also the implementation can be easier, which also shows a favorable aspect. The method of simply and quickly detecting characteristics of speech to be incremented includes, for example, a method of detecting only such consonant characteristics as stop and fricative (drastic changes in frequency component) in an initial part, or formant transition (changes in formant component) in a glide part.

Second Embodiment

Figure 5:
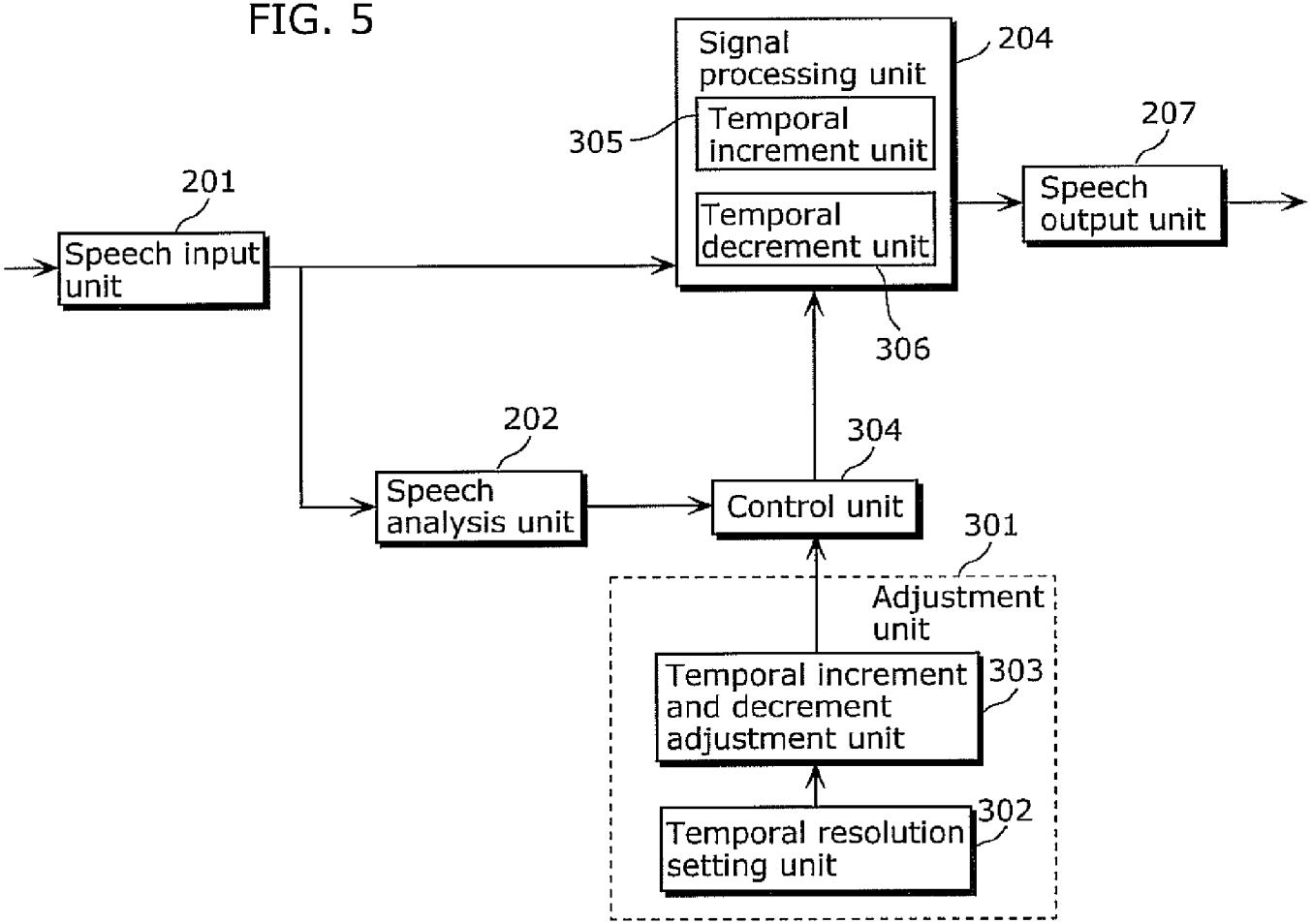
FIG. 5 is a block diagram showing a configuration of a hearing aid according to the second embodiment of the present invention.

FIG. 5 is a block diagram showing a configuration of a hearing aid according to the second embodiment of the present invention. The hearing aid shown in FIG. 5 includes a speech input unit 201, a speech analysis unit 202, an adjustment unit 301, a control unit 304, a signal processing unit 204, and a speech output unit 207. Components common with FIG. 1 are given the same numerals in FIG. 5 and not described.

The hearing aid shown in FIG. 5 is different from the hearing aid according to the first embodiment in configurations of the adjustment unit 301, the control unit 304, and the signal processing unit 204.

The adjustment unit 301 includes a temporal resolution setting unit 302 and a temporal increment and decrement adjustment unit 303, and according to auditory temporal resolution of a user wearing the hearing aid according to an implementation of the present invention, the adjustment unit 301 adjusts an amount of time by which part of speech signals is incremented and an amount of time by which the another part of the speech signals is decremented. For example, the adjustment unit 301 makes an adjustment such that an increment time of a consonant segment is longer for a user having more significantly impaired auditory temporal resolution than for a user having less impaired auditory temporal resolution.

In order to adapt to each user the hearing aid according to an implementation of the present invention, the user uses a fitting program or the like before wearing the hearing aid, to set, as one of fitting parameters, an adjustment amount for the temporal resolution of that hearing aid, and the adjustment amount is set in the temporal resolution setting unit 302. Using the adjustment amount thus set, a value of the temporal resolution for each user is set in the temporal resolution setting unit 302. While the adjustment amount is set based on an external input of the hearing aid in this description, the configuration is not limited to the configuration in which the adjustment amount is set by the temporal resolution setting unit 302 and may be a configuration in which the adjustment amount is set by the adjustment unit 301 including the temporal increment and decrement adjusting unit 303.

For example, the temporal resolution setting unit 302 will have, as a value of auditory temporary resolution of a hearing aid user, data obtained using a method of measuring temporal resolution, or a parameter of an extent of impairment of the temporary resolution according to the measurement.

The method of measuring temporary resolution is described in detail by "A„ Introduction to the Psychology of Hearing" (written by Moore, B. C. J., and Japanese translation supervised by Ohgushi Kengo). For example, gaps are inserted to broadband or narrowband noise so as to make the noise intermittent, and a detection threshold of the gaps is measured to determine an extent of impairment of temporal resolution. Such measurement of temporal resolution may be conducted on the occasion of fitting of hearing aid or seeing an otolaryngologist, and it is also conceivable to use a method of measuring temporal resolution, as sound is made, with a receiver of the hearing aid that includes a measurement program embedded therein. In addition, because the impairment of temporal resolution tends to increase the influence of temporal masking, it may also be possible to simply calculate the extent of impairment of the temporal resolution by measuring temporal masking properties. For example, according to the above "A„ introduction to the Psychology of Hearing", using a short signal called probe and a masker, the extent of impairment of the temporal resolution may be calculated simply by measuring a perceptible probe delay and an amount of masking for the probe. More simply, the temporal resolution may be measured by estimating the extent of impairment of the temporal resolution according to the percentage of questions answered correctly in dictation tests in which text is given at different rates of speech.

On the basis of the temporal resolution value set by the temporal resolution setting unit 302, the temporal increment and decrement adjustment unit 303 sets adjustment amounts for adjusting the amount of time (increment time) to be incremented by the temporal increment unit 305 of the signal processing unit 204 and the amount of time (decrement time) to be decremented by the temporal decrement unit 306 of the signal processing unit 204.

To be specific, referring to the temporal resolution value set by the temporal resolution setting unit 302, the temporal increment and decrement adjustment unit 303 sets the increment time and the decrement time to be relatively short when the extent of impairment of the temporal resolution is small, and the temporal increment and decrement adjustment unit 303 sets the increment time and the decrement time to be relatively long when the extent of impairment is large, for example. Thus, according to the extent of impairment of user's temporal resolution, a consonant is temporally incremented until the user can percept the consonant, with the result that consonants, which are short in duration, can be more perceptible.

The control unit 304 provides the signal processing unit 204 with the adjustment amounts set by the temporal increment and decrement adjustment unit 303 together with the control signal according to the detection result from the speech analysis unit 202. In other words, on the basis of the sound type (such as a vowel, a consonant, or the other) analyzed by the speech analysis unit 202, the control unit 304 determines which processing (such as increment or decrement) is to be done on that sound. The control unit 304 then sends to the signal processing unit 204 a control signal containing information such as a segment and a processing detail of the sound, together with the adjustment amounts set by the temporal increment and decrement adjustment unit 303, thereby controlling the signal processing unit 204.

The temporal increment unit 305 temporally increments a consonant segment based on the adjustment amount and the control signal provided to the signal processing unit 204 by the control unit 304. This temporal increment of the consonant segment is performed in the same manner as the temporal increment unit 205 of FIG. 1, but an amount of time by which the consonant segment is to be incremented is determined also based on the received adjustment amount.

The temporal decrement unit 306 temporally decrements a vowel or the like segment based on the adjustment amount and the control signal provided to the signal processing unit 204 by the control unit 304. This temporal decrement is performed in the same manner as the temporal decrement unit 206 of FIG. 1, but an amount of time by which the vowel or the like segment is decremented is determined also based on the received adjustment amount.

As above, in this second embodiment, the temporal resolution setting unit 302 and the temporal increment and decrement adjustment unit 303 enable adjustment of the increment and decrement times for speech according to user's auditory temporal resolution. This makes it possible to provide a hearing aid and a hearing-aid processing method which enable further improved hearing of consonants that is suitable for each individual.

Third Embodiment

It is known that the user's temporal resolution changes depending on sound pressure (sound volume). Accordingly, this third embodiment exemplifies, as follows, the case where the increment processing is performed according to sound pressure of a received speech signal.

Figure 6:
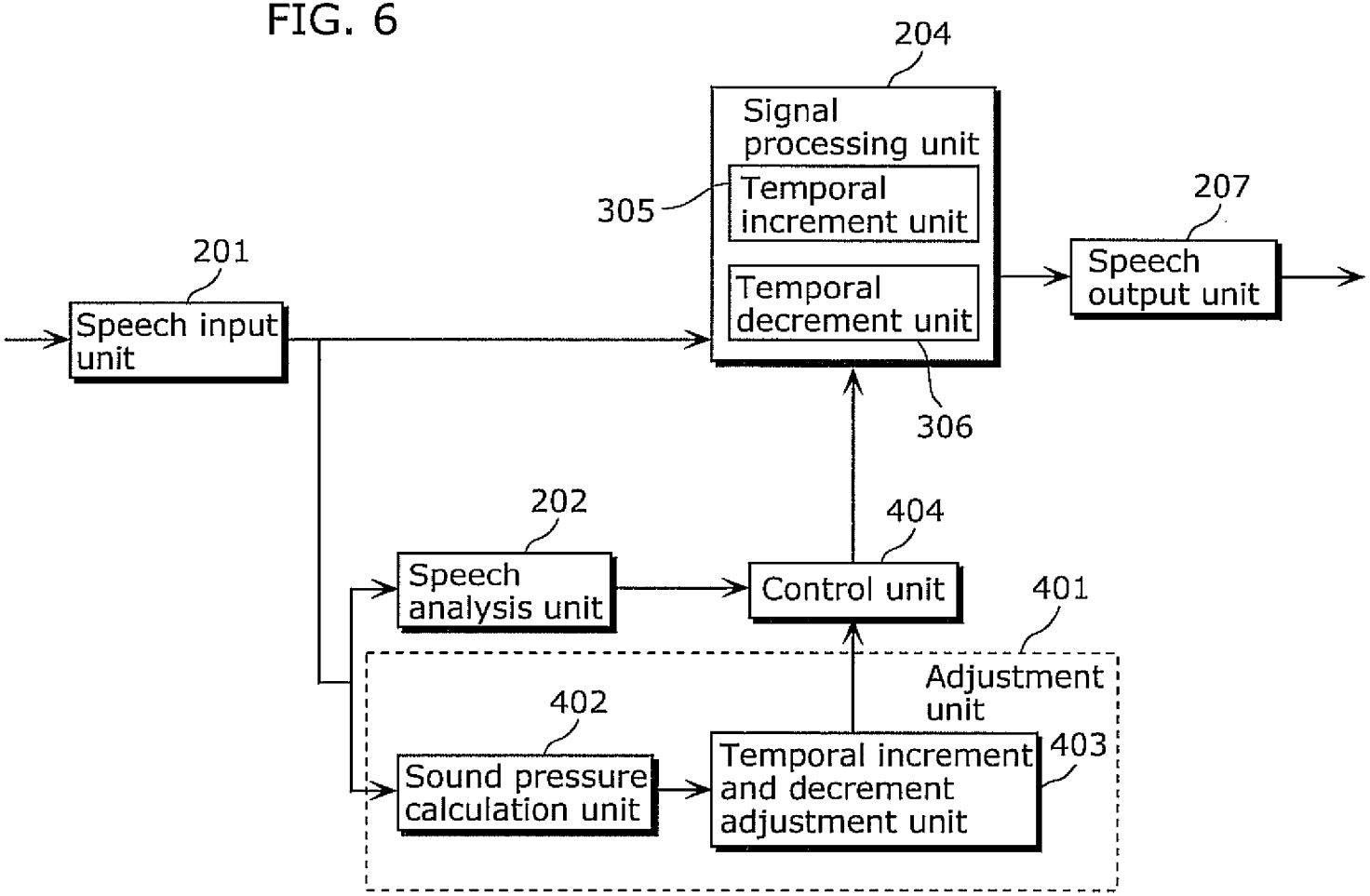
FIG. 6 is a block diagram showing a configuration of a hearing aid according to the third embodiment of the present invention.

FIG. 6 is a block diagram showing a configuration of a hearing aid according to the third embodiment of the present invention. The hearing aid shown in FIG. 6 includes a speech input unit 201, a speech analysis unit 202, an adjustment unit 401, a control unit 404, a signal processing unit 204, and a speech output unit 207. Components common with FIG. 1 or 5 are given the same numerals and not described.

The hearing aid shown in FIG. 6 is different from the hearing aid according to the first embodiment in configurations of the adjustment unit 401 and the control unit 404.

The adjustment unit 401 includes a sound pressure calculation unit 402 and a temporal increment and decrement adjustment unit 403, and according to sound pressure of input speech received by the speech input unit 201, the adjustment unit 401 adjusts an amount of time by which part of speech signals is incremented and an amount of time by which another part of the speech signals is decremented.

To be specific, the sound pressure calculation unit 402 calculates sound pressure, per unit time, of the input speech received by the speech input unit 201.

On the basis of the sound pressure (value) calculated by the sound pressure calculation unit 402, the temporal increment and decrement adjustment unit 403 sets adjustment amounts for adjusting the amount of time to be incremented by the temporal increment unit 305 and the amount of time to be decremented by the temporal decrement unit 306. For example, the temporal increment and decrement adjustment unit 403 sets the increment time and the decrement time to be relatively short when the sound pressure value calculated by the sound pressure calculation unit 402 is larger than a predetermined value, and the temporal increment and decrement adjustment unit 403 sets the increment time and the decrement time to be relatively long when the above sound pressure value is equal to or smaller than the predetermined value. The predetermined value represents a sound pressure value which is a predetermined standard for the increment time and the decrement time. Furthermore, for example, the temporal increment and decrement adjustment unit 403 sets the amount of time by which a consonant segment is to be incremented, to be shorter when the sound pressure value calculated by the sound pressure calculation unit 402 is larger than a predetermined value than when the sound pressure value calculated by the sound pressure calculation unit 402 is equal to or smaller than the predetermined value.

The control unit 404 provides the signal processing unit 204 with the adjustment amount set by the temporal increment and decrement adjustment unit 403 together with the control signal according to the detection result from the speech analysis unit 202. In other words, on the basis of the sound type (such as a vowel, a consonant, or the other) analyzed by the speech analysis unit 202, the control unit 404 determines which processing (such as increment or decrement) is to be done on that sound. The control unit 404 then sends to the signal processing unit 204 a control signal containing information such as a segment and a processing detail of the sound, together with the adjustment amounts set by the temporal increment and decrement adjustment unit 403, thereby controlling the signal processing unit 204.

By thus changing the increment time and the decrement time depending on the sound pressure of input speech received by the speech input unit 201, sufficiently intelligible speech with high sound pressure, for example, can have a consonant therein sound longer and be prevented from becoming less intelligible or becoming unnatural that is an adverse influence of the temporal increment. At the same time, when the sound pressure is low, it is possible to assist perception of consonants by increasing the time in which a consonant is sounding.

The user's temporal resolution changes depending also on the sound pressure (sound volume), and this change is different from a user to another. It is therefore preferable that before wearing a hearing aid, a user be undergo a hearing check for each sound pressure level to obtain a parameter for hearing at each sound pressure level. In this case, it may be possible that the obtained parameter for hearing on each sound pressure level is provided to the adjustment unit 401, and in the temporal increment and decrement adjustment unit 403, an adjustment amount is set to determine the increment time and the decrement time appropriate for the sound pressure.

It may also be possible that speech intelligibility of a consonant and a vowel for each sound pressure level is measured, a parameter for hearing at each intelligibility level is provided to the adjustment unit 401 including the temporal increment and decrement adjustment unit 403, and the above adjustment amount is set to determine the increment time and the decrement time appropriate for the sound pressure.

(First Variation)

Figure 7:
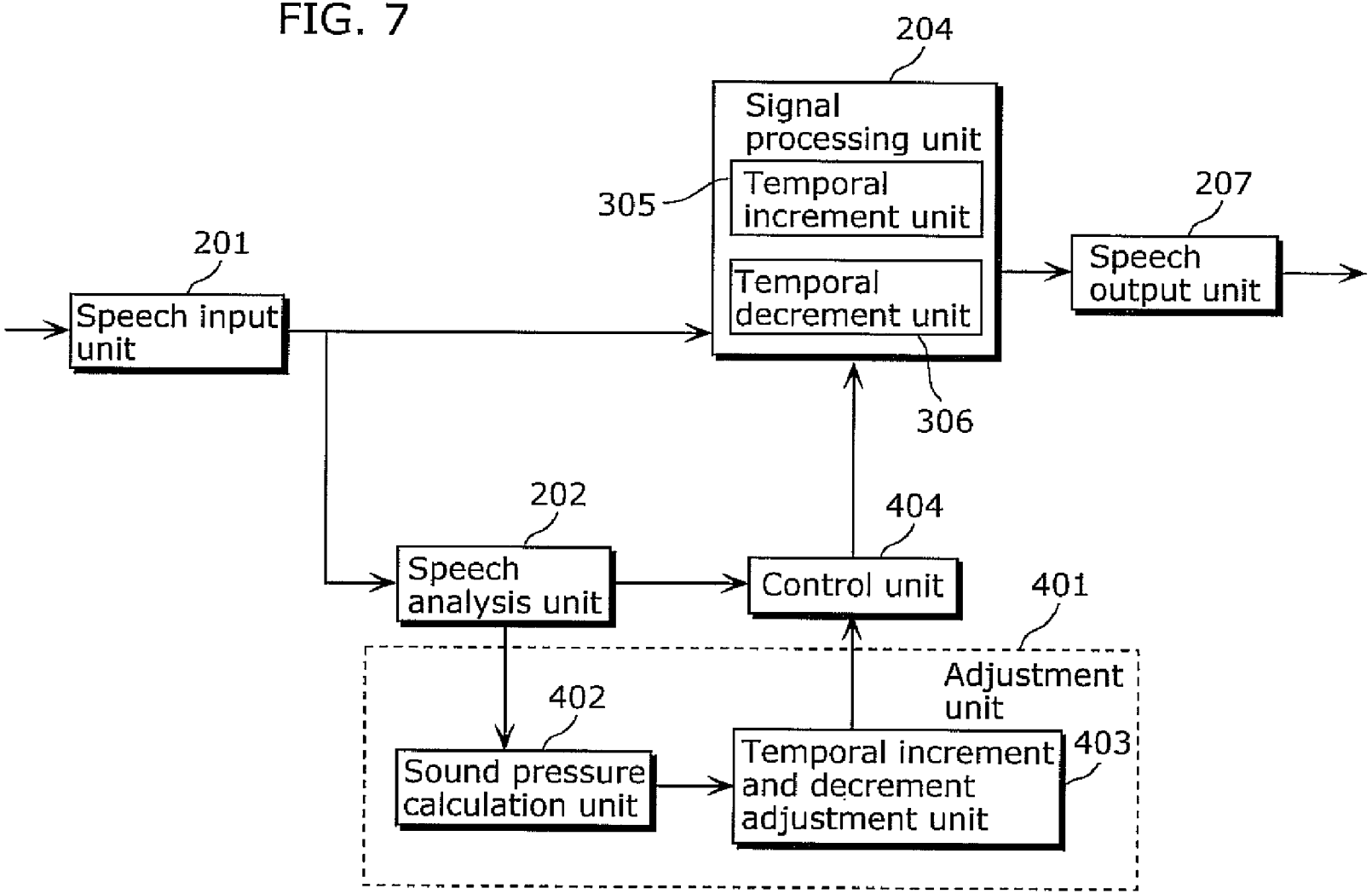
FIG. 7 is a block diagram showing a configuration of a hearing aid according to the first variation of the third embodiment of the present invention.

FIG. 7 is a block diagram showing a configuration of a hearing aid according to the first variation of the third embodiment of the present invention.

The hearing aid of FIG. 7 is different from that of FIG. 6 in that the sound pressure calculation unit 402 calculates sound pressure of only a segment determined as a sound segment by the speech analysis unit 202 while the sound pressure calculation unit 402 of FIG. 6 calculates sound pressure, per unit time, of the input speech received by the speech input unit 201. With the configuration as shown in FIG. 7, the processing can be efficient without calculation of sound pressure of a segment acoustically regarded as soundless or a meaningless segment of noise or the like in the speech.

As above, the sound pressure calculation unit 402 and the temporal increment and decrement adjustment unit 403 of the adjustment unit 401 enable adjustment of the increment and decrement times according to a level of sound pressure of input speech received by the speech input unit 201. This makes it possible to provide a hearing aid and a hearing-aid processing method which can prevent speech deterioration caused by increment and decrement of part of sufficiently intelligible speech with high sound pressure. In addition, the adjustment of the increment time and the decrement time of speech according to user's hearing at each sound pressure level allows for speech hearing improvement more suitable for each individual. Furthermore, by adjusting the increment time and the decrement time of speech according to intelligibility of a consonant and a vowel at each sound pressure level, it is possible to improve hearing of speech.

(Second Variation)

Figure 8:
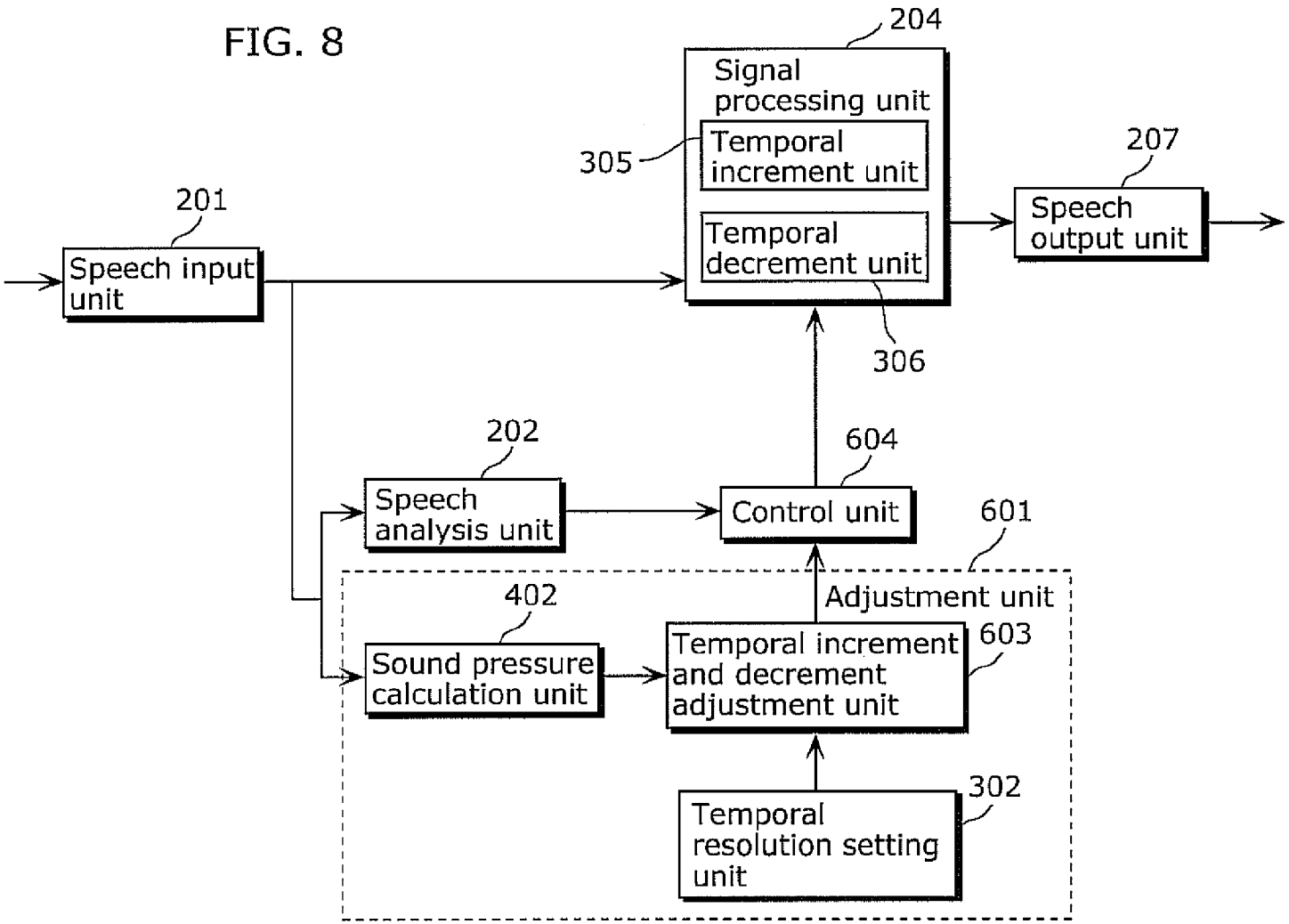
FIG. 8 is a block diagram showing a configuration of a hearing aid according to the second variation of the third embodiment of the present invention.

FIG. 8 is a block diagram showing a configuration of a hearing aid according to the second variation of the third embodiment of the present invention. Components common with FIG. 1, 5, or 6 are given the same numerals and not described.

The hearing aid of FIG. 8 is an alternative example of the configuration of FIG. 6 using the adjustment unit 401 and therefore different from the hearing aid of FIG. 6 according to the third embodiment in a configuration of an adjustment unit 601.

The adjustment unit 601 shown in FIG. 8 includes a temporal resolution setting unit 302, a sound pressure calculation unit 402, and a temporal increment and decrement adjustment unit 603.

On the basis of the sound pressure value calculated by the sound pressure calculation unit 402 and the temporal resolution value set by the temporal resolution setting unit 302, the temporal increment and decrement adjustment unit 603 sets adjustment amounts and provides them to a control unit 604. The temporal increment and decrement adjustment unit 603 may be configured such that, as explained with reference to FIG. 7, the sound pressure calculation unit 402 performs calculation for only a segment determined as a sound segment by the speech analysis unit 202.

The control unit 604 provides the signal processing unit 204 with the adjustment amounts set by the temporal increment and decrement adjustment unit 603 together with the control signal according to the detection result from the speech analysis unit 202. In other words, on the basis of the sound type (such as a vowel, a consonant, or the other) analyzed by the speech analysis unit 202, the control unit 604 determines which processing (such as increment or decrement) is to be done on that sound. The control unit 604 then sends to the signal processing unit 204 a control signal containing information such as a segment and a processing detail of the sound, together with the adjustment amounts set by the temporal increment and decrement adjustment unit 603, thereby controlling the signal processing unit 204.

As above, it is possible to adjust the increment time and the decrement time of speech according to both of the sound pressure of input speech and the temporal resolution of a hearing aid user. This makes it possible to provide a hearing aid and a hearing-aid processing method which not only allow for hearing improvement more suitable for each individual but also can prevent the speech deterioration caused by inappropriate increment and decrement for speech.

Fourth Embodiment

Figure 9:
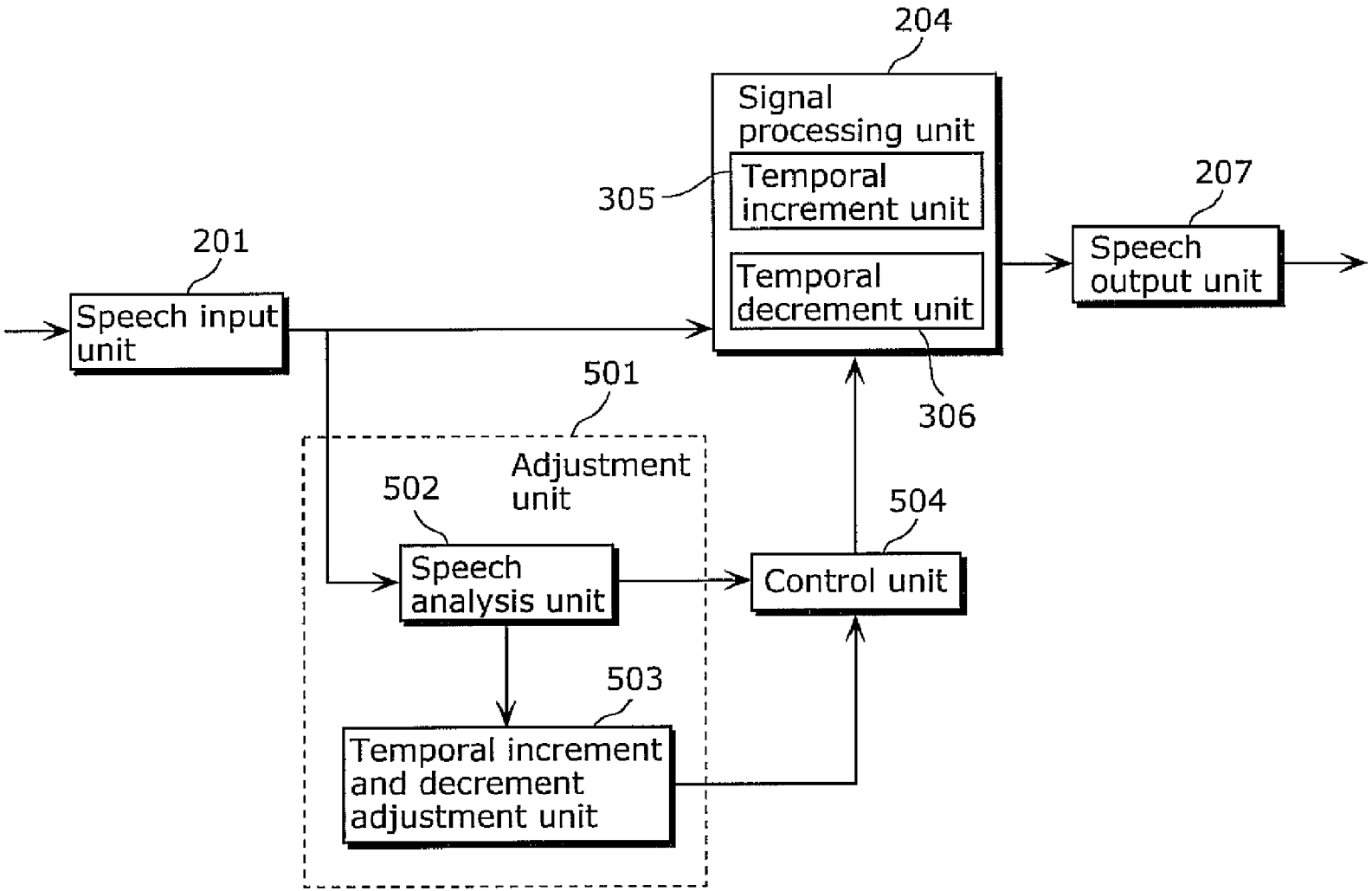
FIG. 9 is a block diagram showing a configuration of a hearing aid according to the fourth embodiment of the present invention.

FIG. 9 is a block diagram showing a configuration of a hearing aid according to the fourth embodiment of the present invention. The hearing aid shown in FIG. 9 includes a speech input unit 201, a speech analysis unit 501, a control unit 504, a signal processing unit 204, and a speech output unit 207. Components common with FIG. 1, 5, or 6 are given the same numerals and not described.

The hearing aid shown in FIG. 9 is different from the hearing aid of FIG. 1 according to the first embodiment in configurations of the adjustment unit 501, the control unit 504, and the signal processing unit 204. The hearing aid shown in FIG. 9 is different from the hearing aid of FIG. 5 according to the third embodiment in configurations of the adjustment unit 501 and the control unit 504.

The adjustment unit 501 includes, as shown in FIG. 9, a speech analysis unit 502 and a temporal increment and decrement unit 503, and according to a type of a consonant in speech received by the speech input unit 201, the adjustment unit 501 sets adjustment amounts for adjusting an amount of time by which part of speech signals is incremented and an amount of time by which another part of the speech signals is decremented.

To be specific, the speech analysis unit 502 determines whether the speech received by the speech input unit 201 is a segment acoustically regarded as soundless or a sound segment, and when it is determined that the speech is a sound segment, the speech analysis unit 502 determines whether the speech is a consonant segment or a vowel segment. When it is determined that the speech is a consonant segment, the speech analysis unit 502 determines a consonant type of the consonant segment.

The consonant type includes, although depending on how to classify, the following according to "Speech/Acoustic Information Digital Signal Processing" written by Shikano, et al., for example: nasal (m, n), unvoiced fricative (f, s, sh), voiced fricative (z, zh), glottal fricative (h), unvoiced stop (p, t, k), voiced stop (b, d, g), unvoiced affricative (ts, ch), semivowel (w), and diphthong (y).

More detailed classification is as follows, for example: stop such as unvoiced labial stop (p), unvoiced alveolar stop (t), unvoiced velar stop (k), voiced labial stop (b), voiced alveolar stop (d), and voiced velar stop (g); fricative such as unvoiced alveolar fricative (s), unvoiced palatal fricative (sh), voiced alveolar fricative (z), voiced palatal fricative (zh), and glottal fricative (h); affricate such as unvoiced palatal affricate (ch)

and unvoiced alveolar affricate (ts); labial nasal (m); alveolar nasal (n); flap (l); labial semivowel (w); and palatal semivowel (diphthong) (y).

In the speech analysis unit 502, the consonant type can be determined by detecting vowel segments from speech signals of speech received by the speech input unit 201 and then estimating a speech segment between the vowel segments based on temporal patterns. To be specific, among acoustic characteristics (properties on the spectrum) of consonants, that is, a rapid or gradual intensity change in the leading part (initial part), a short-lasting formant frequency change (formant transition part), which is a so-called glide, in a part following the initial part, and a constant formant frequency, the initial part and the glide are referred to and the consonant type can thereby be specified. In the following, a specific explanation shall be given with some consonant types as examples.

Figure 10A:
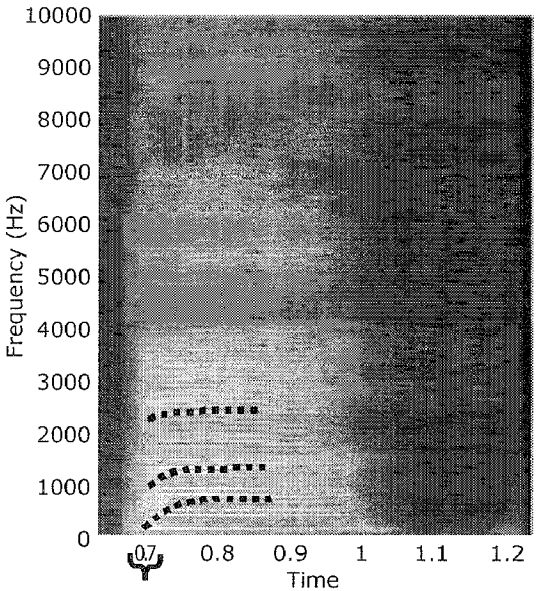
FIG. 10A shows acoustic characteristics of unvoiced stop.
Figure 10B:
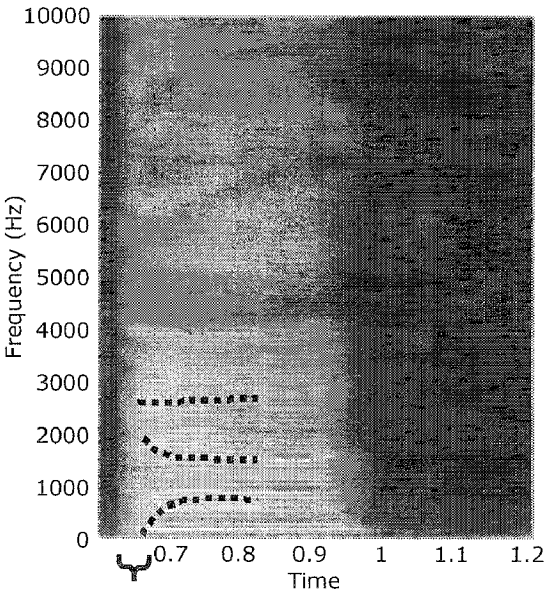
FIG. 10B shows acoustic characteristics of unvoiced stop.
Figure 10C:
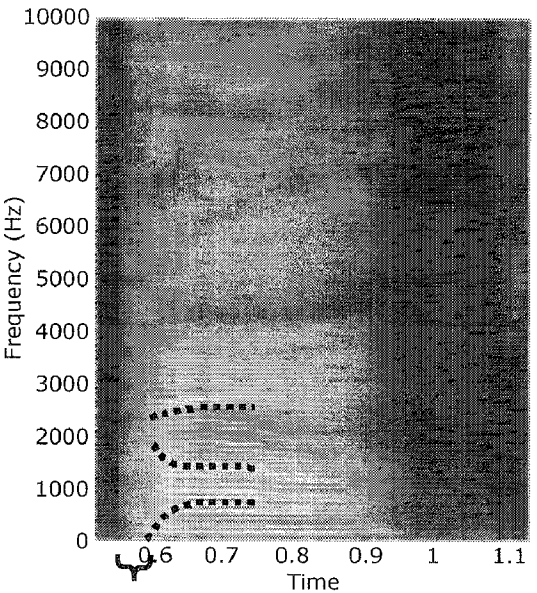
FIG. 10C shows acoustic characteristics of unvoiced stop.

FIGS. 10A to 10C are images (spectrograms) showing acoustic characteristics of unvoiced stop. FIG. 10A shows acoustic characteristics of male voice "pa" as one example of the unvoiced stop. FIG. 10B shows acoustic characteristics of male voice "ta" as one example of the unvoiced stop. FIG. 10C shows acoustic characteristics of male voice "ka" as one example of the unvoiced stop. In these figures, a vertical axis represents frequencies and a horizontal axis represents time. In the images, shading indicates sound intensity, and a brighter area indicates a higher-intensity component contained in the speech signals.

In this case, as shown in FIGS. 10A to 10C, a formant frequency change (formant transition) called glide, which follows the initial part, is different and moreover, a stop part (a rapid change in sound intensity) in the initial (leading) part is observed, as acoustic characteristics of the unvoiced stop (p, t, k), which is one of the consonant types. In the unvoiced stop (p, t, k), not only a difference in the formant transition but also differences in the length and the frequency components of the initial (leading) stop part can be referred to for distinction. Examples are given below.

Figure 11A:
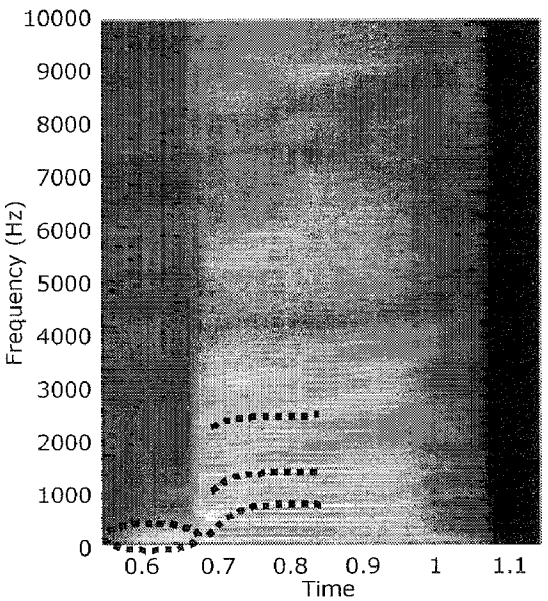
FIG. 11A shows acoustic characteristics of voiced stop.
Figure 11B:
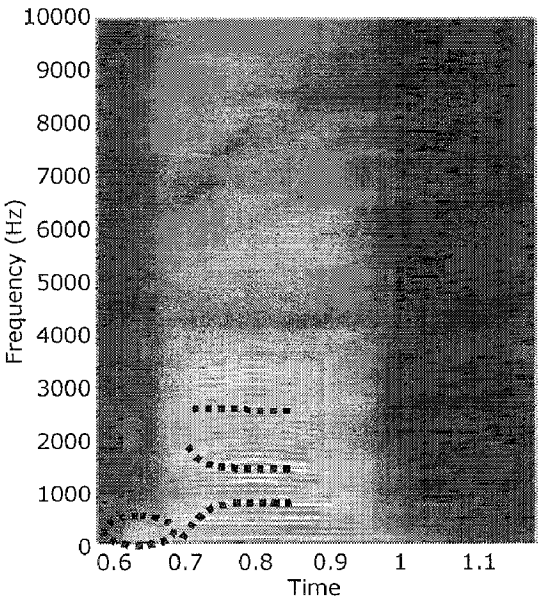
FIG. 11B shows acoustic characteristics of voiced stop.
Figure 11C:
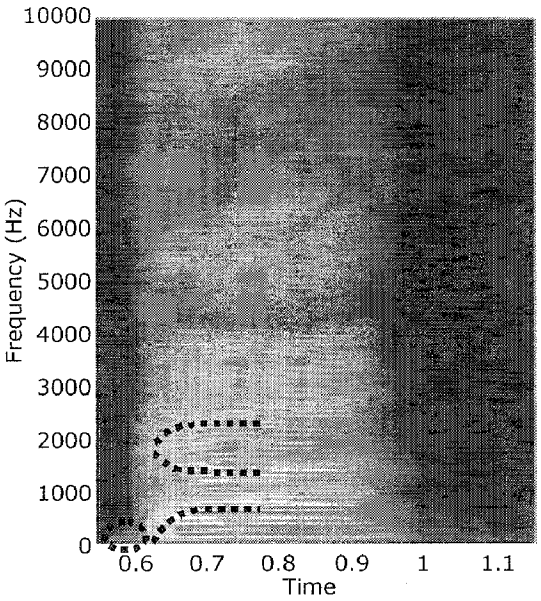
FIG. 11C shows acoustic characteristics of voiced stop.

FIGS. 11A to 11 C show acoustic characteristics of voiced stop. FIG. 11A shows acoustic characteristics of male voice "ba" as one example of the voiced stop. FIG. 11B shows acoustic characteristics of male voice "da" as one example of the voiced stop. FIG. 11C shows acoustic characteristics of male voice "ga" as one example of the voiced stop.

In this case, as shown in FIGS. 11A to 11C, a buzz bar (leading low-frequency component) in the initial (leading) part and a short-lasting (in the order of several tens of ms) formant frequency change called glide in a part following the initial part, are observed as acoustic characteristics of the voiced stop (b, d, g), which is one of the consonant types. In the voiced stop (b, d, g), a length in time of the buzz bar, a formant frequency change, and the like can be referred to for distinction.

Figure 12A:
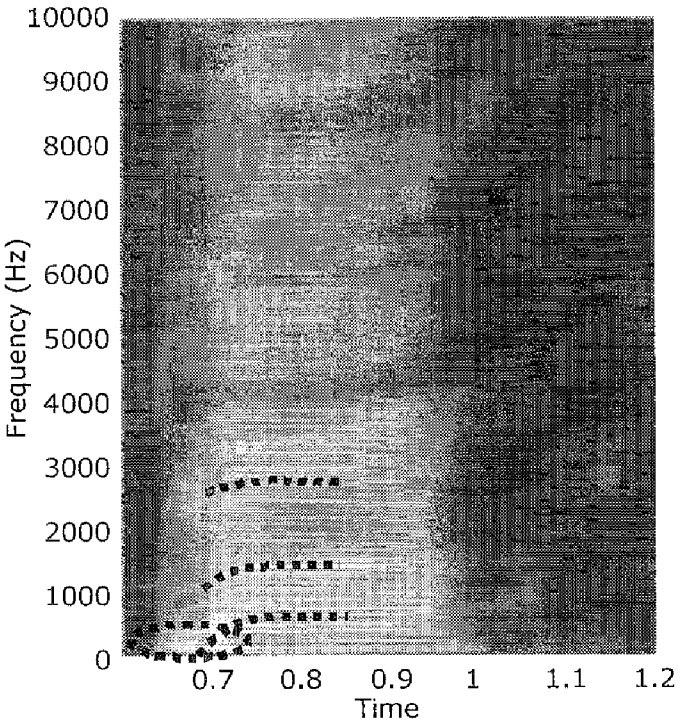
FIG. 12A shows acoustic characteristics of nasal.
Figure 12B:
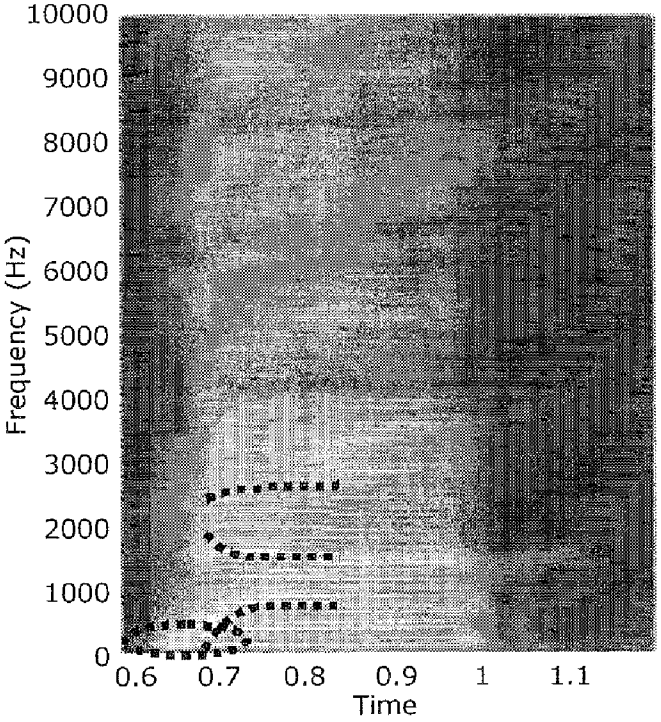
FIG. 12B shows acoustic characteristics of nasal.
Figure 13A:
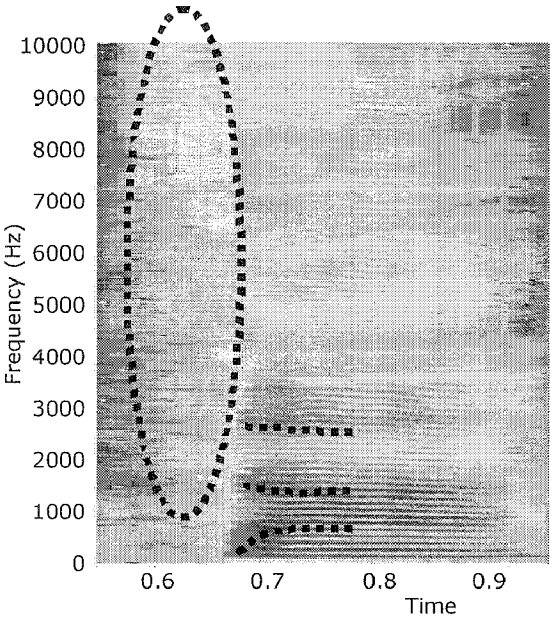
FIG. 13A shows acoustic characteristics of fricative.
Figure 13B:
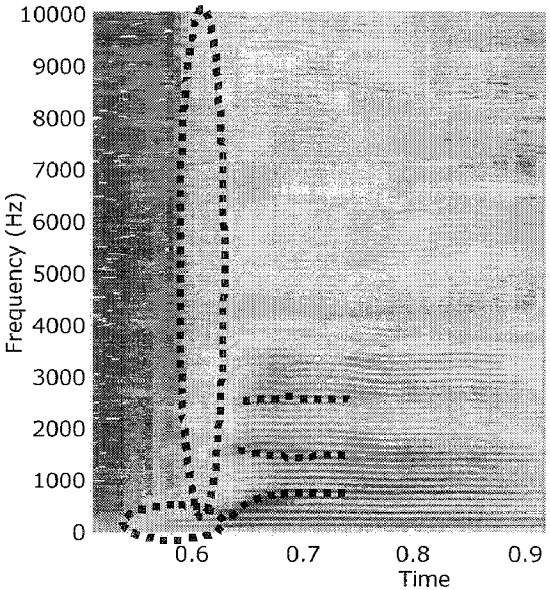
FIG. 13C shows acoustic characteristics of fricative.
Figure 13C:
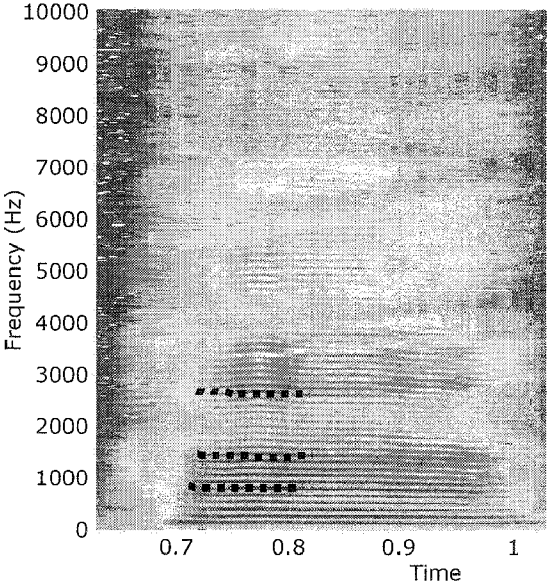

FIGS. 12A and 12B show acoustic characteristics of nasal. FIG. 12A shows acoustic characteristics of male voice "ma" as one example of the nasal. FIG. 10B shows acoustic characteristics of male voice "na" as one example of the nasal.

In this case, as shown in FIGS. 12A and 12B, concentration of energy around 200 Hz is observed in the initial (leading) part and a formant frequency change is observed in a part following the initial part, as acoustic characteristics of the nasal (m, n), which is one of the consonant types. In the nasal (m, n), a form of the formant frequency change can be referred to for distinction.

Other consonant classification algorisms are also applicable, but by introducing the consonant classification method as above, the speech analysis unit 502 is capable of determining (specifying) a consonant type from characteristics of the initial intensity change and the short-lasting formant frequency change called glide, based on acoustic characteristics (properties on the spectrum) of consonants.

Subsequently, the signal processing unit 204 performs the increment processing. In the increment processing, for example, glides (formant transition part) of the nasal (m, n) and the voiced stop (b, d, g) are incremented. Thus, only a part (consonant) whose temporal change serves as a clue is subject to the increment processing so as to make the change perceptible. Furthermore, for example, the stop and affricative parts are incremented. Thus, a part (consonant) with short sound duration is subject to the increment processing so as to make such components perceptible.

According to the consonant type determined by the speech analysis unit 502, the temporal increment and decrement adjustment unit 503 sets adjustment amounts for adjusting the increment time and the decrement time in the temporal increment unit 305 and the temporal decrement unit 306 of the signal processing unit 204.

For example, the temporal increment and decrement adjustment unit 503 sets the adjustment amounts for the increment time and the decrement time as follows, according to the consonant type determined by the speech analysis unit 502. That is, the temporal increment and decrement adjustment unit 503 previously holds such data, in form of a table or the like, as a hearing aid user's hearing test result indicating which consonant the user can easily percept and which consonant the user has difficulty perceiving, using classification based on a position of articulation, a manner of articulation, a presence or absence of vocal cord vibration, or the like of consonants. The temporal increment and decrement adjustment unit 503 then refers to the data of a hearing test or the like and thereby sets relatively large adjustment amounts for the increment time and the decrement time on a consonant estimated to be less perceptible while setting relatively small adjustment amounts for the increment time and the decrement time on a consonant estimated to be more perceptible.

Thus, when the temporal increment and decrement adjustment unit 503 determines the increment and the decrement based on the data such as a hearing test result indicating the hearing aid user's perceptible consonants and less perceptible consonants, it is possible to enhance the consonant recognition ratio.

For example, when the consonant type determined by the speech analysis unit 502 is an unvoiced stop, the temporal increment and decrement adjustment unit 503 sets such small adjustment amounts as not to confuse the sound with a voiced stop, and when the consonant type determined by the speech analysis unit 502 is a voiced stop, the temporal increment and decrement adjustment unit 503 sets such relatively large adjustment amounts as to clarify a difference from an unvoiced stop. This makes it possible to address the problem that a hearing-impaired person with reduced resolution has difficulty distinguishing an unvoiced stop from a voiced stop. It is to be noted that this problem is caused by an increased difficulty of a hearing-impaired person with reduced temporal resolution in correctly perceiving a voice onset time (VOT), which is a factor in distinguishing those sounds. For such a consonant, it is possible to enhance the consonant recognition ratio by clarifying a difference in VOT, that is, a difference between an unvoiced stop and a voiced stop, using adjustment amounts which are different from when the consonant is an unvoiced stop to when the consonant is a voiced stop.

The temporal increment and decrement adjustment unit 503 holds, as data such as a hearing test result, a table which associates each consonant with the hearing aid user's hearing information about perceptibility of each consonant or an adjustment amount set for each consonant, for example. As a matter of course, such a table is not limited to being held by the temporal increment and decrement adjustment unit 503 and may be held by a storage unit provided in the adjustment unit 501.

Furthermore, the table indicating the data such as a hearing test result may either be standardized data applicable to hearing aid users in general or be data based on hearing of a certain individual using the hearing aid.

The table indicating the data such as a hearing test result and the temporal increment and decrement adjustment unit 503 performing the increment processing with use of the table are explained in more detail.

FIG. 14 shows one example of an increment ratio table. The increment ratio table shown in FIG. 14 shows a relation between the temporal resolution and the increment ratio for each consonant component (type) and thus indicates a multiplying factor (adjustment amount) to be used in the increment according to the consonant type. In the figure, a value of the temporal resolution 20 (ms) is a time indicating consonant recognition ability of hearing aid users in general and set in advance.

As shown in FIG. 14, for example, in the case of the voiced labial stop b, the temporal increment and decrement adjustment unit 503 increments the length of time of the consonant b by a factor of 4.5. Furthermore, for example, in the glottal fricative h, the temporal increment and decrement adjustment unit 503 increments the length of time of the consonant h by a factor of 1.8. In the table, a factor of 1.0 given to some consonant types indicates that the temporal increment and decrement adjustment unit 503 does not increment the length of time of the consonant.

It is to be noted that values in the increment ratio table shown in FIG. 14 are merely one example where the multiplying factors for the increment time are set for each combination of the consonant type with auditory temporal resolution of a user wearing the hearing aid. Those values may, of course, be other values as long as they are the increment ratios at which the hearing aid user can perceive the consonants. For example, the palatal semivowel (diphthong), which has a slow temporal glide change, does not need to be incremented much, but the unvoiced stop (p, t, k) shown in FIGS. 10A to 10C and the voiced stop shown in FIGS. 11A to 11C, which have rapid temporal glide changes, may be set to have longer increment time than those exemplified. Likewise, the value of temporal resolution shown in the increment ratio table is not limited to 20 ms and may be 25 ms or 15 ms. This value may be any value which can be set as a value of hearing aid users in general.

Furthermore, the consonant types shown in the increment ratio table are not limited to those consonant types shown in FIG. 14. For example, as shown in FIG. 15, the consonant types may be types of groups into which the consonants are roughly classified based on the common characteristics. In this case, the increment ratio is given for each consonant type, that is, for each of the groups into which the consonants are roughly classified. The groups into which the consonants are roughly classified are not limited to the voiced stop, the unvoiced stop, the unvoiced fricative, the voiced fricative, the unvoiced affricate, and the nasal as shown in FIG. 16 and may be groups of labial, alveolar, and the like. The increment ratio for each of these groups may be set using a representative value (for example, an average value, a maximum value, or a minimum value) within the corresponding group. This representative value within the group may either be set in advance or be set based on the value of increment ratio for each consonant within the corresponding group.

FIG. 16 shows one example of a minimum temporal resolution table. The minimum temporal resolution table shown in FIG. 16 indicates, for each consonant type, the minimum temporal resolution required to perceive (discriminate) the consonant. The temporal resolution of the hearing aid user (listener) is compared with the above minimum temporal resolution, and in the case where it is determined that the consonant is not perceptible, the increment processing is performed. The temporal resolution of the hearing aid user (listener) is, for example, 25 (ms) and set in advance.

As shown in FIG. 16, for example, in the case of the labial nasal m, the temporal increment and decrement adjustment unit 503 increments the length of time of the consonant m by a factor of 1.3 resulting from 25 (ms)/19.3 (ms). In the case of the voiced alveolar stop d, for example, the temporal increment and decrement adjustment unit 503 increments the length of time of the consonant d by a factor of 6.1 resulting from 25 (ms)/4.1 (ms). In the case of the palatal semivowel (diphthong) y, for example, denoted by (33.5) in FIG. 16, this indicates that the sound can be recognized without increments and therefore, the temporal increment and decrement adjustment unit 503 increments the length of time of the consonant y by a factor of 1.0 (which means no increment).

As above, the temporal increment and decrement adjustment unit 503 increments the length of time of the consonant by a factor which is obtained by dividing the auditory temporal resolution of the hearing aid user (listener) by the minimum temporal resolution set in the minimum temporal resolution table for a consonant type determined by the speech analysis unit 202.

It is to be noted that values in the minimum temporal resolution table shown in FIG. 16 are merely one example and therefore may be other values as long as they lead to the increment time ratio at which the hearing aid user can perceive the consonants. For example, the palatal semivowel (diphthong), which has a slow temporal glide change, does not need to be incremented much, but the unvoiced stop (p, t, k) shown in FIGS. 10A to 10C and the voiced stop shown in FIGS. 11A to 11C, which have rapid temporal glide changes, may be set to have longer increment time than those exemplified. Likewise, the value of temporal resolution of the hearing aid user (listener) set in advance is not limited to 25 ms and may be 20 ms or 15 ms. This value may be any value which can be set as a value of hearing aid users in general.

Furthermore, as in the above case, the consonant types shown in the minimum temporal resolution table are not limited to those consonant types shown in FIG. 16. For example, as shown in FIG. 15, the consonant types may be types of groups into which the consonants are roughly classified. Other descriptions the same as those given in the above case of the increment ratio table are not repeated.

The above increment ratio table and minimum temporal resolution table are, as described above, not limited to being held by the temporal increment and decrement adjustment unit 503 and may be held by a storage unit provided in the adjustment unit 501. The drawing shows one example of the configuration of the temporal increment and decrement adjustment unit 503 in the case where the increment ratio table and the minimum temporal resolution table are held by the temporal increment and decrement adjustment unit 503.

Figure 17:
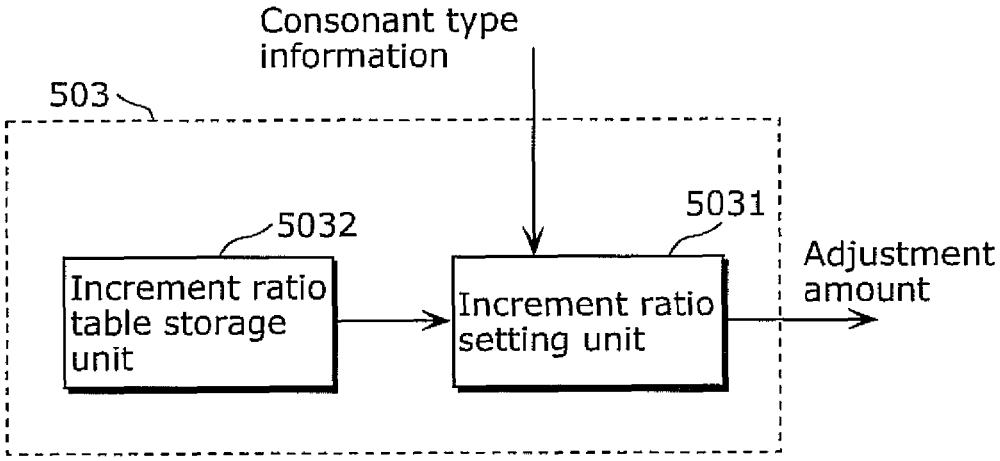
FIG. 17 shows one example of a configuration of a temporal increment and decrement adjustment unit 503.
Figure 18:
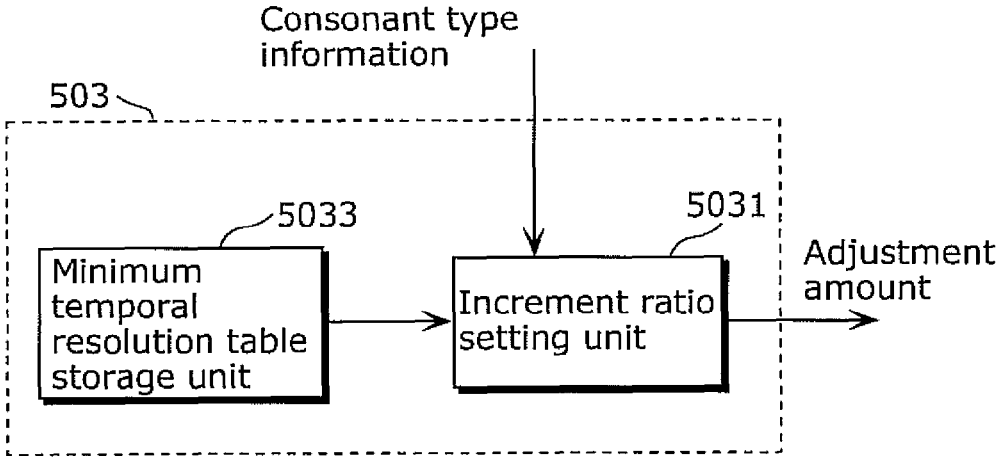
FIG. 18 shows one example of a configuration of a temporal increment and decrement adjustment unit 503.

FIGS. 17 and 18 show one example of the configuration of the temporal increment and decrement adjustment unit 503.

The temporal increment and decrement adjustment unit 503 shown in FIG. 17 includes, for example, an increment ratio setting unit 5031 and an increment ratio table storage unit 5032. The increment ratio table storage unit 5032 holds the above-described increment ratio table. The increment ratio setting unit 5031 sets an increment ratio with reference to the increment ratio table held by the increment ratio table storage unit 5032, based on the temporal resolution of the hearing aid user (listener) and the consonant type. The increment ratio setting unit 5031 outputs to the control unit 504 adjustment amounts including the set increment ratio.

The temporal increment and decrement adjustment unit 503 shown in FIG. 18 includes, for example, an increment ratio setting unit 5031 and a minimum temporal resolution table storage unit 5033. The minimum temporal resolution table storage unit 5033 holds the above-described minimum temporal resolution table. The increment ratio setting unit 5031 refers to the minimum temporal resolution table held by the minimum temporal resolution table storage unit 5033 and compares the minimum temporal resolution with the temporal resolution of the hearing aid user (listener), and when it is determined that the consonant is not perceptible, the increment ratio setting unit 5031 sets an increment ratio. The increment ratio setting unit 5031 outputs to the control unit 504 adjustment amounts including the set increment ratio.

As above, the temporal increment and decrement adjustment unit 503 is capable of setting the adjustment amounts for the increment and the decrement according to a consonant type based on the increment ratio table or the minimum temporal resolution table, thereby allowing an improved recognition ratio of consonants.

The control unit 504 provides the signal processing unit 204 with the adjustment amount set by the temporal increment and decrement adjustment unit 503 together with the control signal according to the detection result from the speech analysis unit 502. In other words, on the basis of the consonant type determined by the speech analysis unit 502, the control unit 504 determines which processing (such as increment or decrement) is to be done on that sound. The control unit 504 then sends to the signal processing unit 204 a control signal containing information such as a segment and a processing detail of the sound, together with the adjustment amounts set by the temporal increment and decrement adjustment unit 503, thereby controlling the signal processing unit 204.

As above, the hearing aid according to the fourth embodiment is configured.

The hearing aid according to the present embodiment is thus capable of adjusting the increment time and the decrement time according to the consonant type with use of the speech analysis unit 502 and the temporal increment and decrement adjustment unit 503 of the adjustment unit 501, thereby allowing improved hearing of consonants according to a consonant type.

(First Variation)

The following shall describe an alternative configuration example of the above-described adjustment unit 501.

Figure 19:
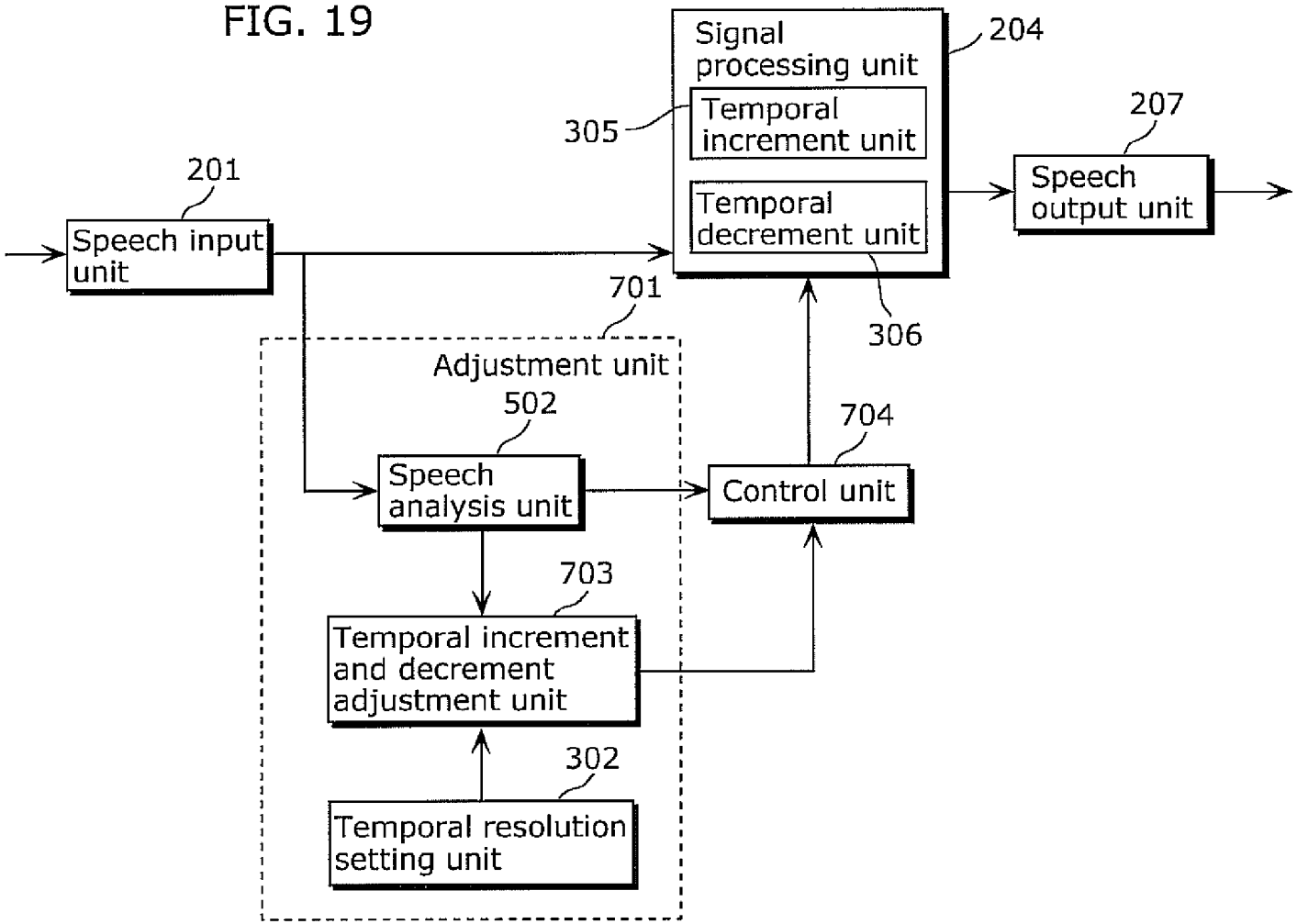
FIG. 19 is a block diagram showing a configuration of a hearing aid according to the first variation of the fourth embodiment of the present invention.

FIG. 19 is a block diagram showing a configuration of a hearing aid according to the first variation of the fourth embodiment of the present invention. The hearing aid shown in FIG. 19 includes a speech input unit 201, an adjustment unit 701, a control unit 704, a signal processing unit 204, and a speech output unit 207. The adjustment unit 701 includes a speech analysis unit 502, a temporal increment and decrement adjustment unit 703, and a temporal resolution setting unit 302. Components common with FIG. 1, 5, or 9 are given the same numerals and not described.

The hearing aid shown in FIG. 19 is different from the hearing aid of FIG. 9 in configurations of the adjustment unit 701 and the control unit 704. To be specific, the adjustment unit 701 in the hearing aid shown in FIG. 19 is different from the adjustment unit 501 in the hearing aid of FIG. 9 in configurations of the temporal increment and decrement adjustment unit 703 and the temporal resolution setting unit 302.

As described above, the speech analysis unit 502 determines whether the speech received by the speech input unit 201 is a segment acoustically regarded as soundless or a sound segment, and when it is determined that the speech is a sound segment, the speech analysis unit 502 determines whether the speech is a consonant segment or a vowel segment. When it is determined that the speech is a consonant segment, the speech analysis unit 502 then determines a consonant type of the consonant segment. To be specific, the speech analysis unit 502 determines (specifies) a consonant type from characteristics of the initial intensity change and the short-lasting formant frequency change called glide, based on acoustic characteristics (properties on the spectrum) of consonants.

Alternatively, the speech analysis unit 502 may determine whether or not the determined consonant segment includes acoustic characteristics to be subject to the increment, and when the determined consonant segment includes the acoustic characteristics to be subject to the increment, an increment segment is set and held.

Before the hearing aid is worn, temporal resolution values for adapting the hearing aid to an individual user are set in the temporal resolution setting unit 302.

The temporal increment and decrement adjustment unit 703 refers to the increment ratio table or the minimum temporal resolution table to set adjustment amounts based on the consonant type determined by the speech analysis unit 502 and the temporal resolution values of the hearing aid user (listener) set in the temporal resolution setting unit 302. The temporal increment and decrement adjustment unit 703 provides the set adjustment amounts to the control unit 704.

With the configuration as above, the temporal increment and decrement adjustment unit 703 is capable of setting the adjustment amounts for adjusting the increment time and the decrement time of speech, according to both of the consonant type of input speech and the temporal resolution of the hearing aid user. This makes it possible to provide a hearing aid and a hearing-aid processing method which enable improved hearing that is more suitable for each individual.

The following shall specifically describe the case where the increment processing is performed on consonants by using the adjustment amount set by the temporal increment and decrement adjustment unit 703 with reference to the previously prepared increment ratio table and the case where the increment processing is performed on consonants by using the adjustment amount set by the temporal increment and decrement adjustment unit 703 with reference to the previously prepared minimum temporal resolution table.

First, the increment processing using the previously prepared increment ratio table is described.

Figure 21:
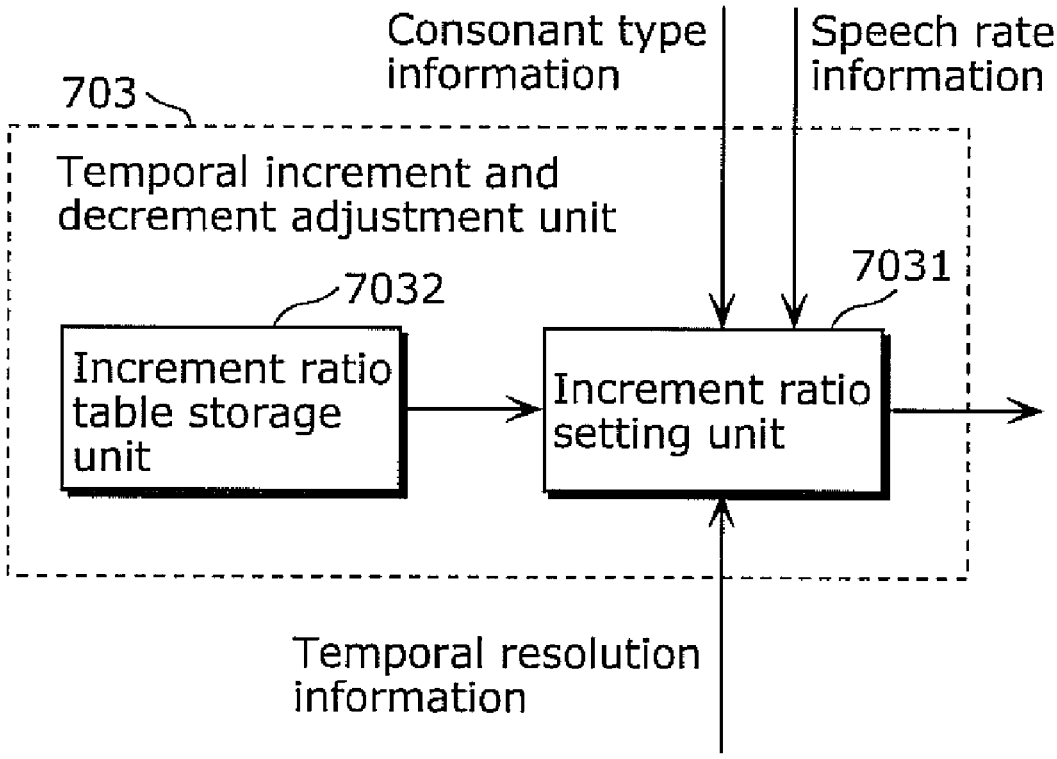
FIG. 21 shows one example of a configuration of a temporal increment and decrement adjustment unit 703.

FIG. 20 shows one example of the increment ratio table. The increment ratio table shown in FIG. 20 shows a relation between the temporal resolution and the increment ratio for each consonant component (type) and thus indicates a multiplying factor (adjustment amount) to be used in the increment according to the consonant type. FIG. 21 is a block diagram showing one example of the configuration of the temporal increment and decrement adjustment unit 703.

The temporal increment and decrement adjustment unit 703 shown in FIG. 21 includes, for example, an increment ratio setting unit 7031 and an increment ratio table storage unit 7032. The increment ratio table storage unit 7032 holds the increment ratio table shown in FIG. 20. The increment ratio setting unit 7031 sets the increment ratio with reference to the increment ratio table held by the increment ratio table storage unit 7032, based on the temporal resolution of the hearing aid user (listener) set by the temporal resolution setting unit 302 and the consonant type. The increment ratio setting unit 7031 outputs to the control unit 704 adjustment amounts including the set increment ratio.

For example, assume that the consonant type determined by the speech analysis unit 502 is a voiced labial stop b and the temporal resolution value of the hearing aid user (listener) set in the temporal resolution setting unit 302 is 15 ms. In this case, the temporal increment and decrement adjustment unit 703 refers to the increment ratio table shown in FIG. 20 and sets an adjustment amount for incrementing the consonant segment determined as the consonant b by a factor of 3.4. As another example, assume that the consonant type determined by the speech analysis unit 502 is a glottal fricative h and the temporal resolution value of the hearing aid user (listener) set in the temporal resolution setting unit 302 is 15 ms. In this case, the temporal increment and decrement adjustment unit 703 refers to the increment ratio table shown in FIG. 20 and sets an adjustment amount for incrementing the consonant segment determined as the consonant h by a factor of 1.4. Other examples are alike and therefore not described herein.

It is to be noted that values in the minimum temporal resolution table shown in FIG. 20 are merely one example and therefore may be other values as long as they lead to the increment time ratio at which the hearing aid user can perceive the consonants. For example, the palatal semivowel (diphthong), which has a slow temporal glide change, does not need to be incremented much, but the unvoiced stop (p, t, k) shown in FIGS. 10A to 10C and the voiced stop shown in FIGS. 11A to 11C, which have rapid temporal glide changes, may be set to have longer increment time than those exemplified. On the other hand, in the case where an increase in the increment time of a consonant whose initial part is relatively short in time, for example, an unvoiced stop, causes confusion with a consonant whose initial part is relatively long in time, for example, a voiced stop, the increment time of the unvoiced stop may be set so as not to exceed the increment time of the voiced stop, or alternatively, the increment time of the voiced stop may be set to be longer.

The control unit 704 provides the signal processing unit 204 with the adjustment amount set by the temporal increment and decrement adjustment unit 703 together with the control signal according to the detection result from the speech analysis unit 502. That is, the control unit 304 sends the control signal and the adjustment amount together to the signal processing unit 204 to thereby control the signal processing unit 204.

An operation example of the hearing aid configured as above is described below.

Figure 22:
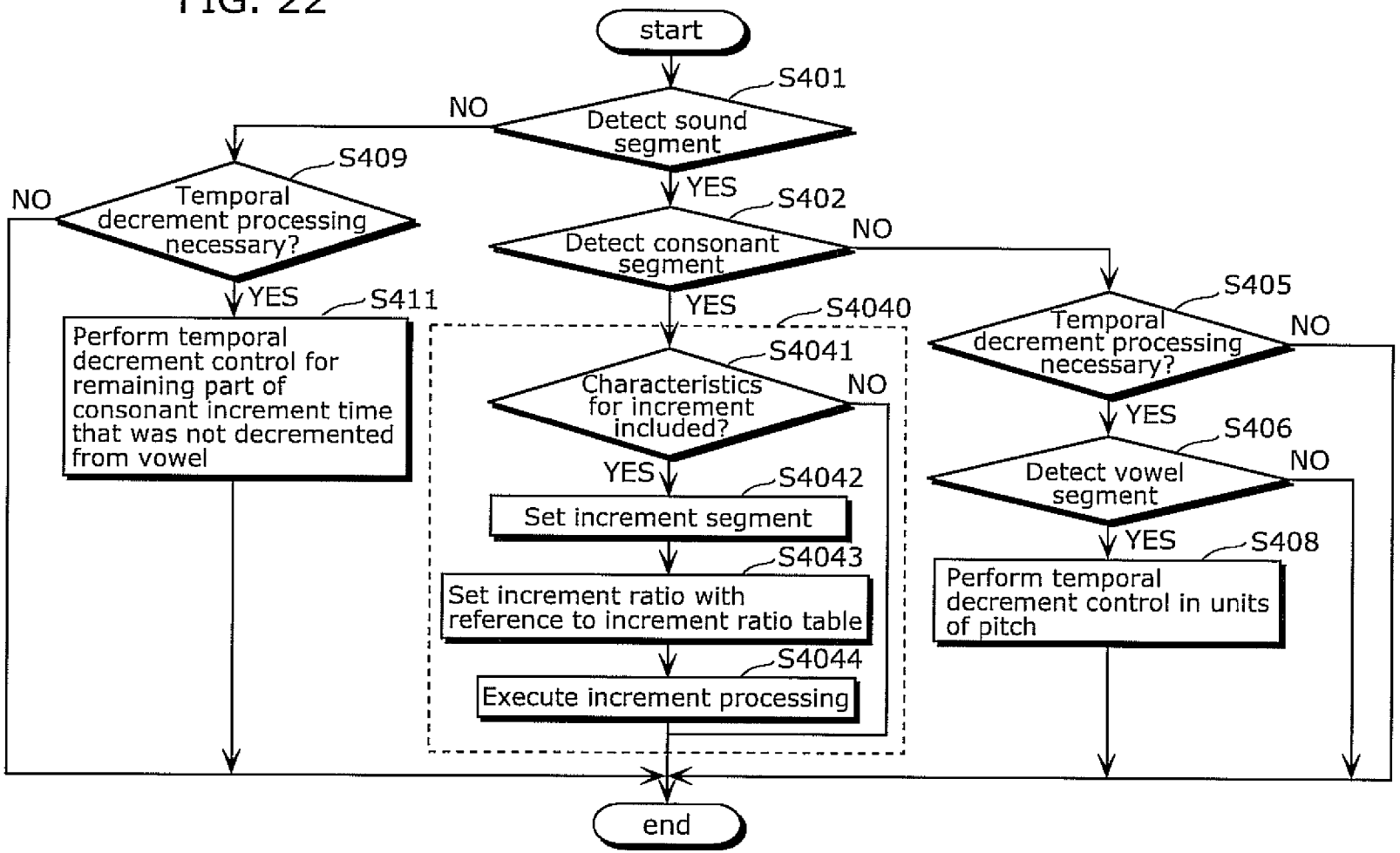
FIG. 22 is a flowchart showing an operation example of a hearing aid according to the first variation of the fourth embodiment of the present invention.

FIG. 22 is a flowchart showing an operation example of the hearing aid according to the first variation of the fourth embodiment of the present invention. The operation from Step S401 to Step S411 is not described here because it is the same as the operation from Step S401 to Step S411 in FIG. 4.

In Step S4040, the speech analysis unit 502 determines whether or not the determined (detected) consonant segment includes the acoustic characteristics to be subject to the increment (S4041). When the speech analysis unit 502 determines that the determined (detected) consonant segment includes the acoustic characteristics to be subject to the increment (YES in S4041), the process proceeds to Step (S4042) of setting an increment segment. When the speech analysis unit 502 determines that the determined (detected) consonant segment does not include the acoustic characteristics to be subject to the increment (NO in S4041), the process ends.

Next, when the consonant segment determined (detected) by the speech analysis unit 502 is set as the increment segment to be subject to the increment processing (S4042), the temporal increment and decrement adjustment unit 703 refers to the increment ratio table as shown in FIG. 20. The temporal increment and decrement adjustment unit 703 then sets adjustment amounts (S4043) for adjusting the increment ratio and amount of time for the increment segment and the amount of time by which the vowel or soundless segment corresponding to the consonant increment time is decremented, according to both of the consonant type of input speech determined (detected) by the speech analysis unit 502 and the temporal resolution of the hearing aid user set in the temporal resolution setting unit 302.

Next, the control unit 704 provides the signal processing unit 204 with the adjustment amounts set by the temporal increment and decrement adjustment unit 703 together with the control signal according to the detection result from the speech analysis unit 502. The signal processing unit 204 executes the increment processing according to the adjustment amounts and the control signal provided by the control unit 704 (S4044). The increment processing herein indicates processing executed on only a part (consonant) whose temporal change serves as a clue, so as to make the change perceptible. For example, glides (formant transition part) of the nasal (m, n) and the voiced stop (b, d, g) are incremented. Furthermore, the increment processing herein also indicates processing executed on a part (consonant) with short sound duration, so as to make such components perceptible. For example, the stop and affricative parts are incremented. In sum, the increment processing is executed on an initial (leading) part and a part following the initial part (formant transition) of a stop or the like.

In the manner as described above, the increment processing is executed using the increment ratio table prepared in advance.

The following shall describe the increment processing using the previously prepared minimum temporal resolution table shown in FIG. 16.

Figure 23:
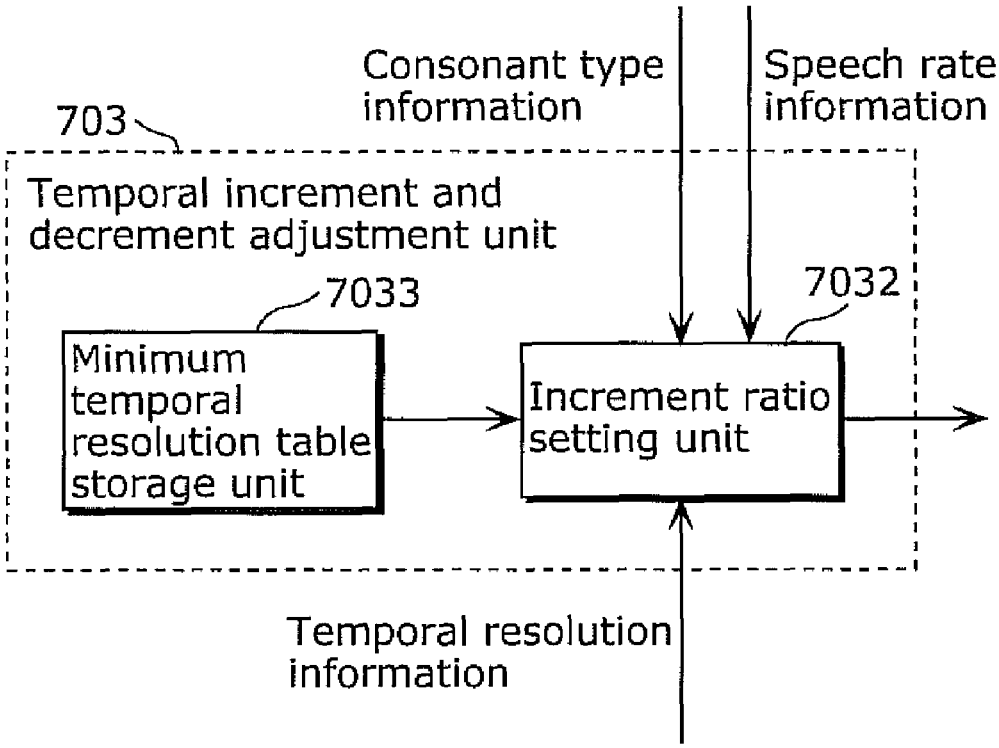
FIG. 23 shows one example of a configuration of a temporal increment and decrement adjustment unit 703.

FIG. 23 shows one example of the configuration of the temporal increment and decrement adjustment unit 703.

The temporal increment and decrement adjustment unit 703 shown in FIG. 23 includes, for example, an increment ratio setting unit 7031 and a minimum temporal resolution table storage unit 7033. The minimum temporal resolution table storage unit 7033 holds the minimum temporal resolution table shown in FIG. 16. The increment ratio setting unit 7031 sets an increment ratio with reference to the minimum temporal resolution table held by the minimum temporal resolution table storage unit 7033, based on the temporal resolution of the hearing aid user (listener) set in the temporal resolution setting unit 302 and the consonant type. The increment ratio setting unit 7031 outputs to the control unit 704 adjustment amounts including the set increment ratio.

For example, assume that the consonant type determined by the speech analysis unit 502 is a labial nasal m and the temporal resolution value of the hearing aid user (listener) set in the temporal resolution setting unit 302 is 25 ms. In this case, the temporal increment and decrement adjustment unit 703 refers to the minimum temporal resolution table shown in FIG. 16 and sets an adjustment amount for incrementing the consonant segment determined as the consonant m by a factor of 1.3 resulting from 25 (ms)/19.3 (ms). As another example, assume that the consonant type determined by the speech analysis unit 502 is a voiced alveolar stop d and the temporal resolution value of the hearing aid user (listener) set in the temporal resolution setting unit 302 is 25 ms. In this case, the temporal increment and decrement adjustment unit 703 refers to the minimum temporal resolution table shown in FIG. 16 and sets an adjustment amount for incrementing the consonant segment determined as the consonant d by a factor of 6.1 resulting from 25 (ms)/4.1 (ms). Other examples are alike and therefore not described herein.

It is to be noted that values in the minimum temporal resolution table shown in FIG. 16 are merely one example and therefore may be other values as long as they lead to the increment time ratio at which the hearing aid user can perceive the consonants. For example, the palatal semivowel (diphthong), which has a slow temporal glide change, does not need to be incremented much, but the unvoiced stop (p, t, k) shown in FIGS. 10A to 10C and the voiced stop shown in FIGS. 11A to 11C, which have rapid temporal glide changes, may be set to have longer increment time than those exemplified. On the other hand, in the case where an increase in the increment time for a consonant whose initial part is relatively short in time, for example, an unvoiced stop, causes confusion with a consonant whose initial part is relatively long in time, for example, a voiced stop, the increment time of the unvoiced stop may be set so as not to exceed the increment time of the voiced stop, or alternatively, the increment time of the voiced stop may be set to be longer.

The control unit 704 provides the signal processing unit 204 with the adjustment amount set by the temporal increment and decrement adjustment unit 703 together with the control signal according to the detection result from the speech analysis unit 502. That is, the control unit 304 sends the control signal and the adjustment amount together to the signal processing unit 204 to thereby control the signal processing unit 204.

The operation example of the hearing aid configured as above is described below.

Figure 24:
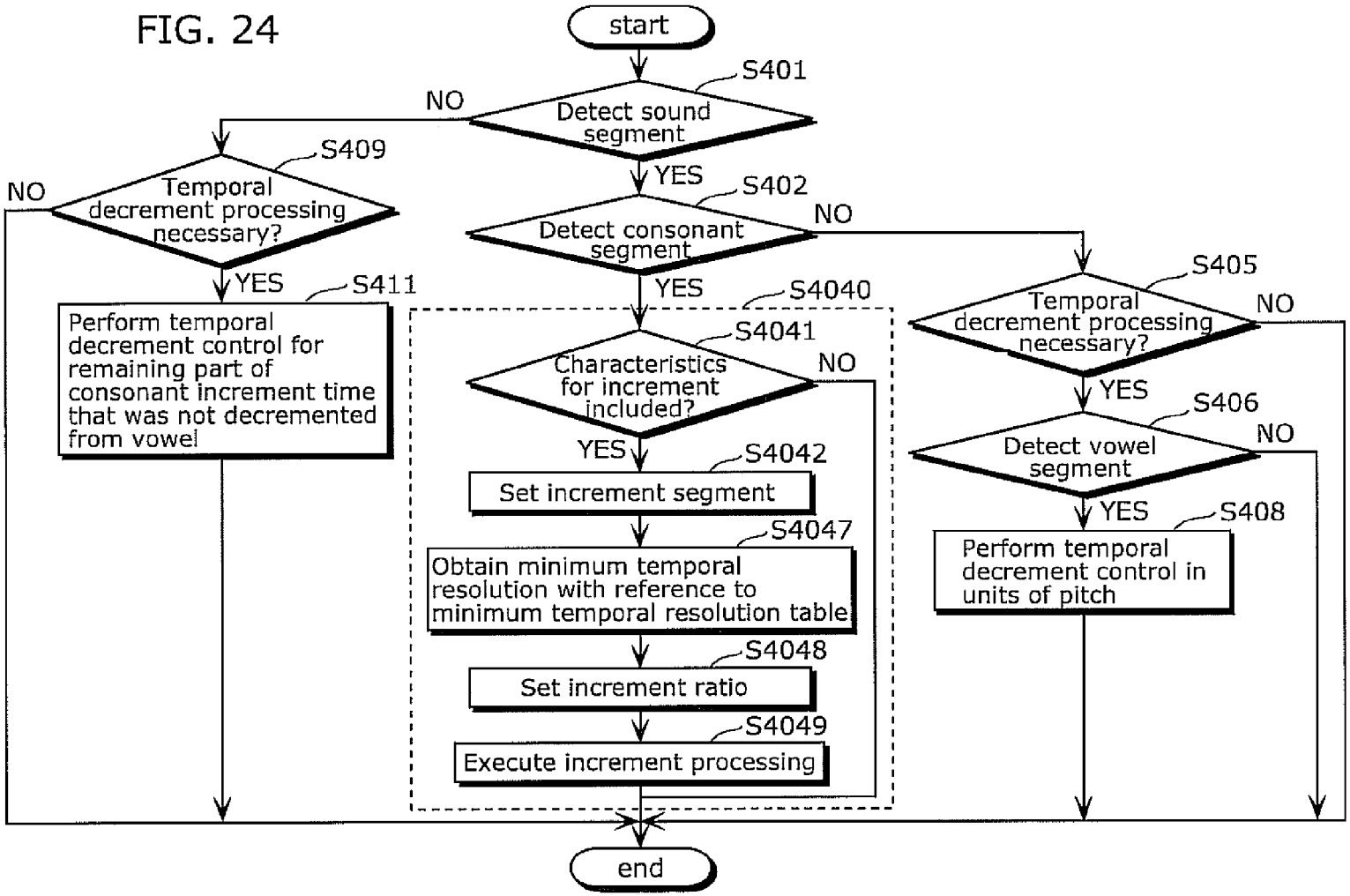
FIG. 24 is a flowchart showing another operation example of a hearing aid according to the first variation of the fourth embodiment of the present invention.

FIG. 24 is a flowchart showing another operation example of the hearing aid according to the first variation of this fourth embodiment. The operation from Step S401 to Step S411 is not described here because it is the same as the operation from Step S401 to Step S411 in FIG. 4. The operation in Step S4041 and Step S4012 is not described here because it is the same as the operation in Step S4041 and Step S4012 in FIG. 22.

In Step S4047, the temporal increment and decrement adjustment unit 703 refers to the minimum temporal resolution table as shown in FIG. 16. The temporal increment and decrement adjustment unit 703 then obtains the minimum temporal resolution (S4047) based on both of the consonant type of input speech determined (detected) by the speech analysis unit 502 and the temporal resolution of the hearing aid user set in the temporal resolution setting unit 302. Subsequently, the temporal increment and decrement adjustment unit 703 sets adjustment amounts (S4048) for adjusting the increment ratio and amount of time for the increment segment and the amount of time by which the vowel or soundless segment corresponding to the consonant increment time is decremented.

Next, the control unit 704 provides the signal processing unit 204 with the adjustment amounts set by the temporal increment and decrement adjustment unit 703 together with the control signal according to the detection result from the speech analysis unit 502. The signal processing unit 204 executes the increment processing according to the adjustment amounts and the control signal provided by the control unit 704 (S4047). The increment processing herein is, as in the above-described case, executed on the initial (leading) part and a part following the initial part (formant transition) of a stop or the like.

As above, the increment processing is executed using the minimum temporal resolution table prepared in advance.

The hearing aid configured as above executes the increment processing for each consonant according to impairment of the temporal resolution of the hearing aid user (listener). This increment processing is based on the temporal resolution and executed using the increment ratio table or minimum temporal resolution table prepared in advance. To be specific, the increment processing is executed on only a part (consonant) whose temporal change serves as a clue, so as to make the change perceptible. For example, glides (formant transition part) of the nasal (m, n) and the voiced stop (b, d, g) are incremented. Furthermore, the increment processing is executed on a part (consonant) with short sound duration, so as to make such components perceptible. For example, the stop and affricative parts are incremented. In other words, the increment processing is executed on an initial (leading) part and a part following the initial part (formant transition) of a stop or the like.

It is to be noted that an extent of impairment of temporal resolution of a hearing aid user (listener) depends on not only a consonant type but also a speech rate as mentioned above.

The speech analysis unit 502 therefore measures a time interval between sounds of consonants, vowels, or the like, for example, to analyze a speech rate and then holds the speech rate information, and the temporal increment and decrement adjustment unit 703 sets adjustment amounts in view of the speech rate information held by the speech analysis unit 502. To be specific, the temporal increment and decrement adjustment unit 703 sets the increment ratio table or the minimum temporal resolution table based on speech at a standard speech rate, and may adjust the table according to the speech rate of speech being listened to. For example, when the speech rate is 1.2 time higher than the standard, a value of the increment ratio table is multiplied by 1.2 or a value of the minimum temporal resolution table is multiplied by 1/1.2.

While the above description takes as a typical example a case where the value of the temporal resolution of the hearing aid user (listener) is known in advance (prepared in advance) and set in the temporal resolution setting unit 302 in the above increment processing, the increment processing is not limited to the above case. For example, before starting the use of the hearing aid according to the present invention, the hearing aid user (listener) may use an adjustment device or the like to estimate (measure) his or her temporal resolution, and the temporal resolution of the hearing aid user (listener) thus estimated (measured) by the adjustment device or the like may be set in the temporal resolution setting unit 302. This adjustment device or the like may be provided either inside or outside the temporal resolution setting unit 302.

A method of estimating the temporal resolution of the hearing aid user (listener) by the adjustment device or the like is exemplified below.

This adjustment device obtains a confusion pattern showing a measurement result as to how the hearing aid user (listener) mishears a consonant, and estimates the temporal resolution of the hearing aid user (listener) from the obtained confusion pattern. For example, when the hearing aid user (listener) mishears a consonant m as a consonant k, the minimum temporal resolution 17.6 ms of the consonant k and the minimum temporal resolution 19.3 ms of the consonant m in the minimum resolution table shown in FIG. 16 are referred to, with the result that the temporal resolution of the hearing aid user (listener) is estimated to be in the order of 18 ms to 19 ms. In this manner, the adjustment device may estimate the temporal resolution of the hearing aid user (listener) from the confusion pattern of the hearing aid user (listener). For the measurement of the confusion pattern, a result of the general speech discrimination test (57S, 67S) may be used, or alternatively, in order to find a boundary in the discrimination, speech which is likely to cause confusion (which is misleading) may also be used, for example.

This adjustment device may also be configured to not only estimate the temporal resolution of the hearing aid user (listener) from his or her confusion pattern but also specify a consonant or a pair of consonants susceptible to confusion and notify the temporal resolution setting unit 302. In this case, the temporal increment and decrement adjustment unit 703 sets adjustment amounts for the consonant or the pair of consonants susceptible to confusion such that acoustic characteristics of the consonant or the pair of consonants susceptible to confusion become prominent, and provides the set adjustment amounts to the control unit. Alternatively, the temporal increment and decrement adjustment unit 703 may take a measure by readjusting the values of the increment ratio table or the minimum temporal resolution table for the consonant or the pair of consonants susceptible to confusion. The signal processing unit 204 then executes the increment processing such that acoustic characteristics of the consonant or the pair of consonants susceptible to confusion become prominent. For example, in the case where the nasals (m, n) or the voiced stops (b, d, g) cause confusion, the increment segment and the increment ratio are set such that a glide difference between these consonants can be perceived. Furthermore, for example, in the case where the labials (p, b, m, w) or the alveolars (t, d, s, z, ts, n) cause confusion, the increment segment and the increment ratio are set such that stop, affricate, or the like in the initial (leading) part can be perceived. In this manner, the hearing aid may execute the increment processing such that acoustic characteristics of the consonant or the pair of consonants susceptible to confusion become prominent.

(Second Variation)

An extent of impairment of temporal resolution of a hearing aid user (listener) depends on not only a consonant type but also a speech volume (sound pressure). The second variation therefore takes another configuration example where the speech volume is taken into account, of the adjustment unit 501 in the above first variation.

Figure 25:
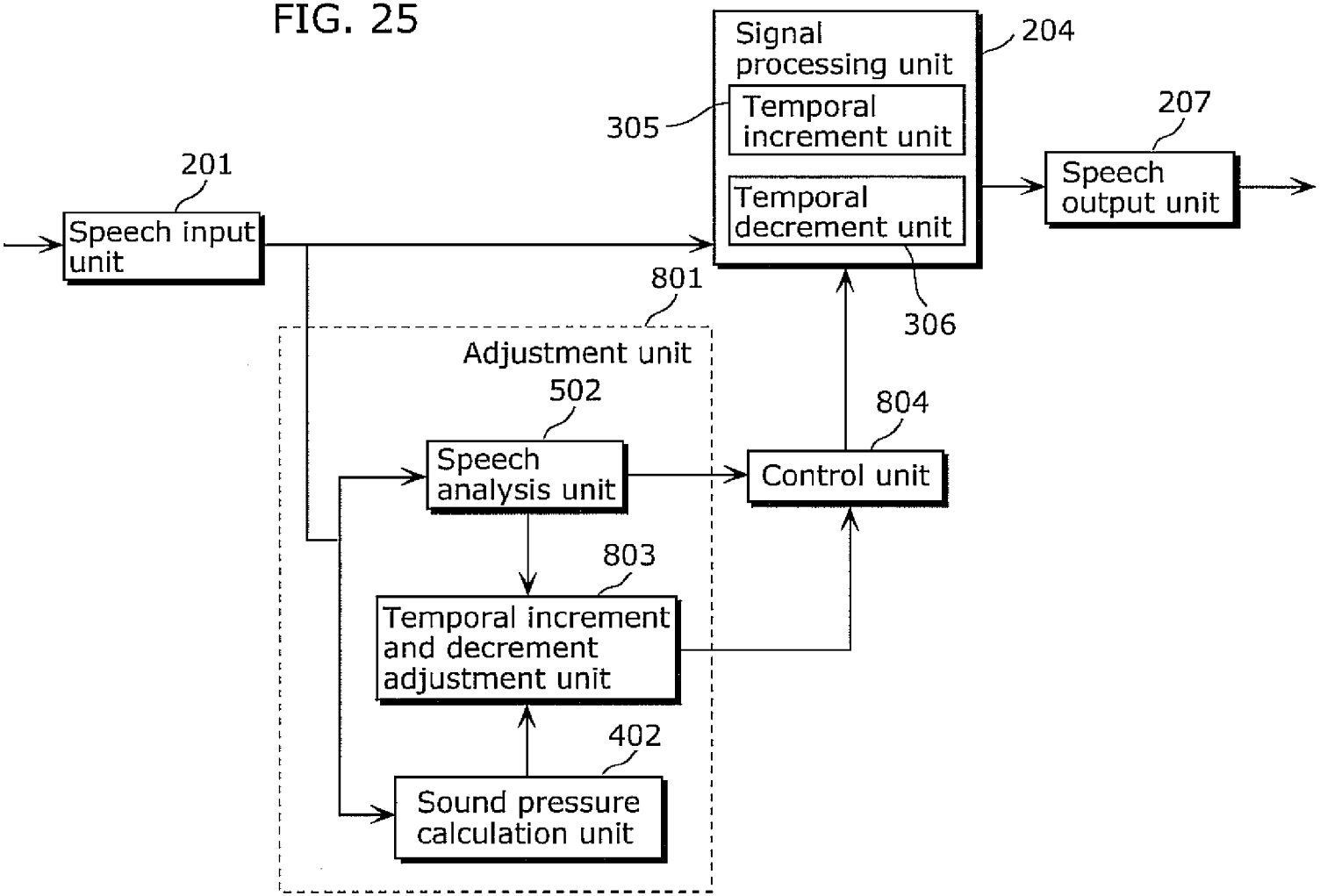
FIG. 25 is a block diagram showing a configuration of a hearing aid according to the second variation of the fourth embodiment of the present invention.

FIG. 25 is a block diagram showing a configuration of a hearing aid according to the second variation of the fourth embodiment of the present invention. The hearing aid shown in FIG. 25 includes a speech input unit 201, an adjustment unit 801, a control unit 804, a signal processing unit 204, and a speech output unit 207. The adjustment unit 801 includes a speech analysis unit 502, a temporal increment and decrement adjustment unit 803, and a sound pressure calculation unit 402. Components common with FIG. 1, 5, or 9 are given the same numerals and not described.

The temporal increment and decrement adjustment unit 803 refers to the increment ratio table and the minimum temporal resolution table and sets an adjustment amount based on the consonant type determined by the speech analysis unit 502 and the sound pressure (value) calculated by the sound pressure calculation unit 402. For example, when the sound pressure calculated by the sound pressure calculation unit 402 is higher than a predetermined value, the temporal increment and decrement adjustment unit 803 sets an adjustment amount by subtracting a value for the predetermined value from the increment ratio set in the increment ratio table corresponding to the consonant type determined by the speech analysis unit 502. When the sound pressure calculated by the sound pressure calculation unit 402 is equal to or lower than a predetermined value, the temporal increment and decrement adjustment unit 803 sets an adjustment amount by adding a value for the predetermined value to the increment ratio set in the increment ratio table corresponding to the consonant type determined by the speech analysis unit 502. The increment ratio setting unit 803 provides the set adjustment amounts to the control unit 804.

The sound pressure calculation unit 402 may be configured to perform calculation only on the segment determined as a sound segment by the speech analysis unit 502 as in the above case of FIG. 8.

The control unit 804 provides the signal processing unit 204 with the adjustment amount set by the temporal increment and decrement adjustment unit 803 together with the control signal according to the detection result from the speech analysis unit 502. In other words, on the basis of the sound type (such as a vowel, a consonant, or the other) analyzed by the speech analysis unit 502, the control unit 804 determines which processing (such as increment or decrement) is to be done on that sound. The control unit 804 then sends to the signal processing unit 204 a control signal containing information such as a segment and a processing detail of the sound, together with the adjustment amount set by the temporal increment and decrement adjustment unit 303, thereby controlling the signal processing unit 204.

In this manner, with reference to the increment ratio table or the minimum temporal resolution table, the increment time and the decrement time for speech can be adjusted according to both of the consonant type of input speech and the sound pressure of the input speech, which makes it possible to provide a hearing aid and a hearing-aid processing method which enable improved hearing suitable for each individual and prevent speech deterioration caused by inappropriate temporal increment and decrement for speech.

(Third Variation)

The following shall describe a still another configuration example of the adjustment unit 501.

Figure 26:
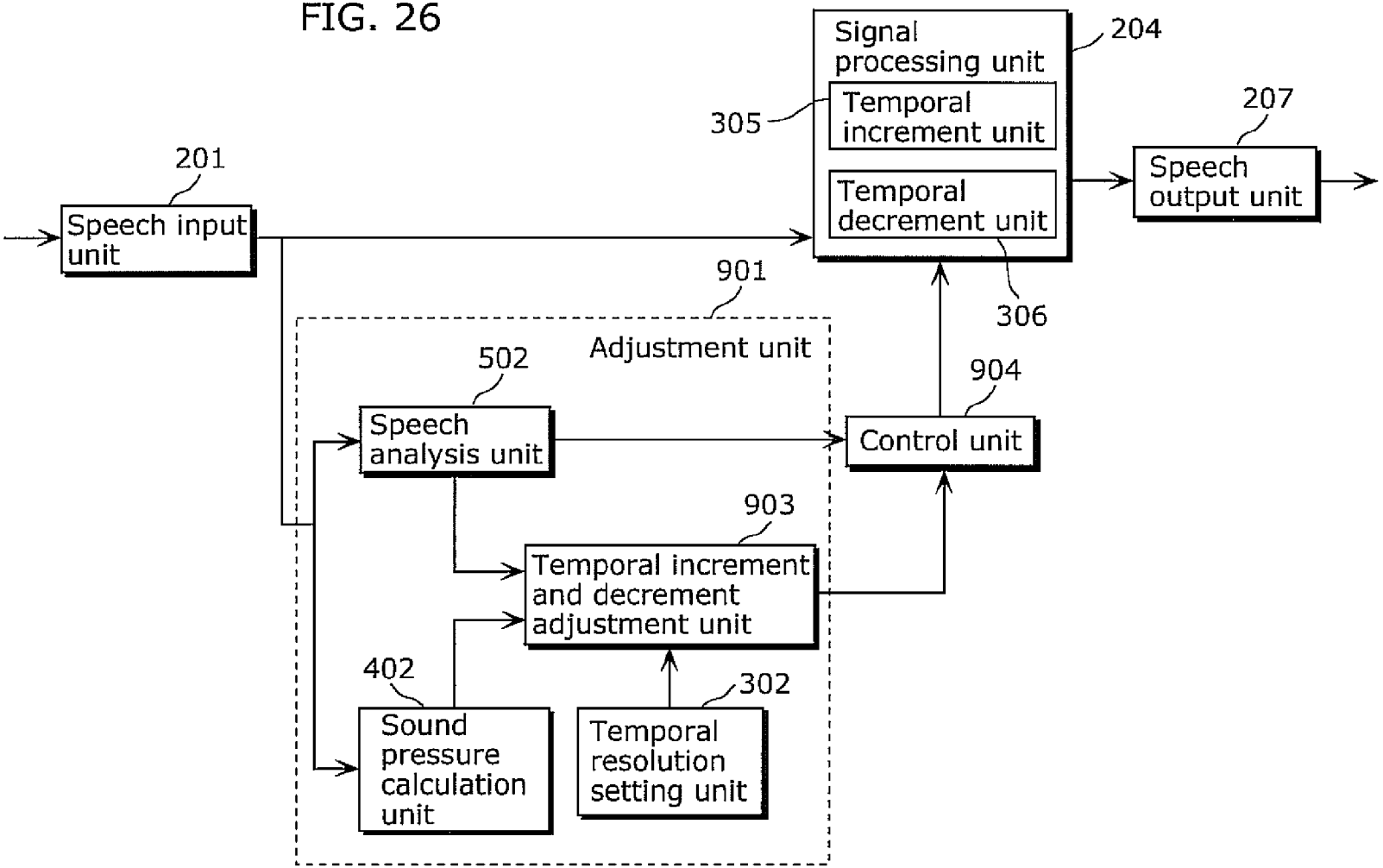
FIG. 26 is a block diagram showing a configuration of a hearing aid according to the third variation of the fourth embodiment of the present invention.

FIG. 26 is a block diagram showing a configuration of a hearing aid according to the third variation of the fourth embodiment of the present invention. The hearing aid shown in FIG. 26 includes a speech input unit 201, an adjustment unit 901, a control unit 904, a signal processing unit 204, and a speech output unit 207. The adjustment unit 901 includes a speech analysis unit 502, a sound pressure calculation unit 402, and a temporal resolution setting unit 302, and a temporal increment and decrement adjustment unit 903. Components common with FIG. 1, 5, or 9 are given the same numerals and not described.

The temporal increment and decrement adjustment unit 903 refers to the increment ratio table or the minimum temporal resolution table to set adjustment amounts based on the consonant type determined by the speech analysis unit 502, the sound pressure value calculated by the sound pressure calculation unit 402, and the temporal resolution value set in the temporal resolution setting unit 302. The increment ratio setting unit 903 provides the set adjustment amounts to the control unit 904. Even in this case, as in the above case of FIG. 8, the sound pressure calculation unit 402 may be configured to perform calculation only on the segment determined as a sound segment by the speech analysis unit 502.

The control unit 904 provides the signal processing unit 204 with the adjustment amount set by the temporal increment and decrement adjustment unit 903 together with the control signal according to the detection result from the speech analysis unit 502.

In this manner, with reference to the increment ratio table or the minimum temporal resolution table, the increment time and the decrement time for speech can be adjusted according to the consonant type of input speech, the sound pressure of the input speech, and the temporal resolution of the user, which makes it possible to provide a hearing aid and a hearing-aid processing method which enable improved hearing suitable for each individual and prevent speech deterioration caused by inappropriate temporal increment and decrement for speech.

When input speech is analyzed to detect a consonant segment and the consonant segment is temporally incremented as above according to the present invention, a hearing-impaired person having difficulty in hearing consonants with reduced resolution can be given a time long enough to perceive consonants. This makes it possible to reduce failures in hearing and recognition of a consonant and improve consonant recognition and further speech recognition.

Only a temporal increment of the consonant segment will cause lag between visual information and auditory information, leading to a problem of losing the hearing assistance with vision. Especially, a consonant difficult to hear becomes more difficult to hear with the lag between the visual information and the auditory information. To deal with this, the hearing aid and the hearing-aid processing method according to the present invention take a measure to generate subsequent consonants on time so as not to cause lag between the visual information and the auditory information. That is, signals for the increment time of the consonant segment are removed from the vowel segment subsequent to the consonant segment, the segment subsequent to the consonant segment and acoustically regarded as soundless, or both of the vowel segment and the soundless segment, with the result that the segment subsequent to the consonant segment is temporally decremented. By so doing, it is possible to prevent the time lag between the visual information and the auditory information. This temporal decrement processing may be performed on not only the vowel segment subsequent to the temporally incremented consonant segment, but also another vowel segment and a meaningless segment of noise or the like.

Furthermore, in the hearing aid and the hearing-aid processing method according to the present invention, data of extent of impairment of temporal resolution of a hearing-impaired person is held in form of table or the like so that the increment time of the consonant segment is adjusted according to the extent of impairment of temporal resolution of the hearing-impaired person. This allows for improved hearing of consonants suitable for each hearing-impaired individual.

Furthermore, in the hearing aid and the hearing-aid processing method according to the present invention, the increment time of the consonant segment is adjusted according to a sound pressure of input speech. This allows for improved hearing of consonants according to the sound pressure.

Furthermore, in the hearing aid and the hearing-aid processing method according to the present invention, the consonant type is determined based on acoustic characteristics of consonants, that is, an initial intensity change and a glide (formant transition part) following the initial part in the sound signals, and according to the consonant type, the increment time of the consonant segment to be subject to the increment processing is adjusted using the PSOLA technique or repetition processing in which a waveform in the formant transition part is copied and repeated, for example. This allows for improved hearing of consonants according to the consonant type. It is to be noted that "according to the consonant type" includes not only "according to each type of the consonants" but also "according to each of the groups into which the consonants are roughly classified", as mentioned above. For example, the consonants may be classified by type roughly into the group of voiced stop, the group of unvoiced stop, the group of unvoiced fricative, the group of voiced fricative, the group of unvoiced affricate, and nasal. Alternatively, the consonants may be classified by type roughly into the group of labial, the group of alveolar, and the like, for example. In this case, the increment ratio may be set using a representative value (for example, an average value, a maximum value, or a minimum value) within the corresponding group. This representative value within each of the groups may either be set in advance or be set based on the value of increment ratio for each consonant within the corresponding group.

Such separate setting of the increment ratio for each of the consonants may possibly cause confusion on the contrary. In that case, correction (modification) can be made by setting the common increment ratio for the consonant or pair of consonants which causes confusion.

Even in the case where the increment processing according to an implementation of the present invention causes confusion of consonants on the contrary, it may be designed to tolerate such confusion in an early stage of use of the hearing aid. This is because if the hearing aid user (listener) can perceive (distinguish) acoustic differences between respective consonants through the increment processing according to an implementation of the present invention, it is even possible to gradually resolve the confusion as the hearing aid user (listener) may learn to correctly recognize the confusion-caused consonant. Thus, the confusion may be tolerated depending on the hearing aid user (listener)'s learning.

As above, the present invention makes it possible to provide a hearing aid and a hearing-aid processing method which improve the recognition ratio of consonants that rapidly change with short duration.

In addition, the above hearing aid and hearing-aid processing method according to an implementation of the present invention may be configured such that characteristics of speech to be subject to the increment processing are detected in a simple and quick manner without analyzing the whole parts of consonants, and the temporal increment for the consonant segment is started. In other words, the configuration may be such that, as long as only consonant characteristic changes such as stop and fricative (drastic changes in frequency component) in an initial part, or formant transition (changes in formant component) in a glide part, are detected, the temporal increment for the consonant segment starts without waiting for the analysis on the whole parts of consonants. In this case, not only the above-mentioned delay in determination of the consonant segment can be reduced, but also the implementation can be easier, which is advantageous.

In addition, a consonant or a vowel may be determined using characteristics of speech analyzed on a time axis instead of characteristics (such as formant) of speech on the spectrum.

Although the present invention has been explained based on the above embodiments, it is a matter of course that the present invention is not limited to the above embodiments. The present invention also includes the following.

Part or all of the components included in each of the above devices may be provided in one system LSI (large scale integration). The system LSI is a super multifunctional LSI manufactured by integrating multiple components into one chip and is specifically a computer system which includes a microprocessor, a ROM, a RAM and so on. The RAM stores a computer program. The microprocessor operates according to the computer program, thereby allowing the system LSI to accomplish its functions.

Part or all of the components included in each of the above devices may be in form of an integrated circuit (IC) card detachable from each of the devices or in form of a single module. The IC card or module is a computer system including a microprocessor, a ROM, a RAM, and so on. The IC card or module may include the above super multifunctional LSI. The microprocessor operates according to the computer program, thereby allowing the IC card or module to accomplish its functions. This IC card or module may have tamper resistance.

The present invention may be a method described above. Furthermore, the present invention may be a computer program which causes a computer to execute the method or may be a digital signal of the computer program.

Furthermore, the present invention may be a computer-readable recording medium including, for example, a flexible disk, a hard disk, a CD-ROM, an MO, a DVD, a DVD-ROM, a DVD-RAM, a BD (Blu-ray Disc), and a semiconductor memory, on which the computer program or the digital signal are recorded. The present invention may also be a digital signal recorded on the recording medium.

Furthermore, the present invention may be transmission of the computer program or the digital signal via a network represented by a telecommunication line, a wired or wireless communication line, and the Internet, or data broadcasting, etc.

Furthermore, the present invention may be a computer system including a memory which stores the above computer program and a microprocessor which operates according to the computer program.

Furthermore, the program or digital signal may be recorded on the recording medium and thus transmitted, or the program or the digital signal may be transmitted via the network or the like, so that the present invention can be implemented by another independent computer system.

The above embodiments and the above variations may be combined.

INDUSTRIAL APPLICABILITY

The present invention is applicable to hearing aids and hearing-aid processing methods and in particular to a hearing aid and a hearing-aid processing method which use a sound processing technique that enables hearing-impaired persons with the sensorineural hearing loss including the presbyacusis to improve hearing of consonants and that enables improved speech intelligibility when applied to a hearing aid, a speech communication device, or a speech reproduction device.

REFERENCE SIGNS LIST

201 Speech input unit
202, 502 Speech analysis unit
203, 304, 404, 504, 604, 704, 804, 904 Control unit
204 Signal processing unit
205, 305 Temporal increment unit
206, 306 Temporal decrement unit
207 Speech output unit
301, 401, 501, 601, 701, 801, 901 Adjustment unit
302 Temporal resolution setting unit
303, 403, 503, 603, 703, 803, 903 Temporal increment and decrement adjustment unit
402 Sound pressure calculation unit
5031, 7031 Increment ratio setting unit
5032, 7032 Increment ratio table storage unit
5033, 7033 Minimum temporal resolution table storage unit

The invention claimed is:

1. A hearing aid comprising:

a speech input unit configured to receive a speech signal from outside;

a speech analysis unit configured to detect a sound segment and a segment acoustically regarded as soundless from the speech signal received by said speech input unit, and to detect a consonant segment and a vowel segment within the detected sound segment;

a signal processing unit configured to temporally increment the consonant segment detected by said speech analysis unit and to temporally decrement at least one of the vowel segment and the segment acoustically regarded as soundless detected by said speech analysis unit; and an adjustment unit configured to adjust an amount of time by which the consonant segment is to be incremented, based on temporal resolution information that indicates auditory temporal resolution of a user of said hearing aid, wherein said signal processing unit is configured to increment, by the amount of time adjusted by said adjustment unit, the consonant segment detected by said speech analysis unit.

2. The hearing aid according to claim 1, wherein said signal processing unit is configured to temporally decrement the vowel segment by removing the speech signal in units of pitch from the vowel segment for part of the amount of time by which the consonant segment is incremented, and to temporally decrement the segment acoustically regarded as soundless by removing the speech signal from the segment acoustically regarded as soundless for a remaining part of the amount of time by which the consonant segment is incremented.

3. The hearing aid according to claim 1, wherein said adjustment unit is configured to adjust the amount of time by which the consonant segment is to be incremented, to be longer when the temporal resolution information indicates that an extent of impairment of the auditory temporal resolution of the user is large, than when the temporal resolution information indicates that an extent of impairment of the auditory temporal resolution of the user is small.

4. The hearing aid according to claim 1, wherein said adjustment unit is further configured to calculate sound pressure of the speech signal and to adjust, based on the calculated sound pressure, the amount of time by which the consonant segment is to be incremented, and said signal processing unit is configured to increment, by the amount of time adjusted by said adjustment unit, the consonant segment detected by said speech analysis unit.

5. The hearing aid according to claim 4, wherein said adjustment unit is configured to adjust the amount of time by which the consonant segment is to be incremented, to be shorter when the calculated sound pressure is higher than a predetermined value, than when the calculated sound pressure is equal to or lower than the predetermined value.

6. The hearing aid according to claim 1, wherein said speech analysis unit is configured to analyze a type of a consonant in the consonant segment, said adjustment unit is further configured to adjust the amount of time by which the consonant segment is to be incremented, based on the type of the consonant analyzed by said speech analysis unit, and said signal processing unit is configured to increment, by the amount of time adjusted by said adjustment unit, the consonant segment detected by said speech analysis unit.

7. The hearing aid according to claim 6, wherein said adjustment unit is configured to hold an increment ratio table in which an increment ratio is set for each type of the consonant, and to refer to the increment ratio table to adjust, for each type of the consonant, the amount of time by which the consonant segment is to be incremented.

8. The hearing aid according to claim 7, wherein in the increment ratio table, an increment ratio is set for each combination of the type of the consonant and the temporal resolution information that indicates the auditory temporal resolution of the user of said hearing aid, and said adjustment unit is configured to refer to the increment ratio table to adjust, for each type of the consonant in combination with the temporal resolution information, the time by which the consonant segment is to be incremented.

9. The hearing aid according to claim 6, wherein the type of the consonant includes types of groups into which consonants are classified by common characteristics.

10. The hearing aid according to claim 6, wherein said adjustment unit is further configured to calculate sound pressure of the speech signal, and to adjust, when the calculated sound pressure is higher than a predetermined value, the amount of time by which the consonant segment is to be incremented, using a value obtained by subtracting a value corresponding to the predetermined value from the increment ratio set in the increment ratio table for the type of the consonant analyzed by said speech analysis unit, and to adjust, when calculated sound pressure is equal to or lower than the predetermined value, the amount of time by which the consonant segment is to be incremented, using a value obtained by adding a value corresponding to the predetermined value to the increment ratio set in the increment ratio table for the type of the consonant analyzed by said speech analysis unit.

11. The hearing aid according to claim 6, wherein said adjustment unit is further configured to hold a minimum temporal resolution table in which a minimum temporal resolution indicating a minimum discriminable temporal resolution is set for each type of the consonant, and to refer to the minimum temporal resolution table to adjust, for each type of the consonant, the amount of time by which the consonant segment is to be incremented.

12. The hearing aid according to claim 11, wherein said adjustment unit is configured to adjust the amount of time by which the consonant segment is to be incremented so that the consonant segment is incremented by a factor which is obtained by dividing the auditory temporal resolution of the user of said hearing aid by the minimum temporal resolution set in the minimum temporal resolution table for the type of the consonant analyzed by said speech analysis unit.

13. The hearing aid according to claim 1, wherein said speech analysis unit is configured to regard detection of an acoustic characteristic of a consonant within the detected sound segment as detection of the consonant segment, and said signal processing unit is configured to start to increment the consonant segment regarded as having been detected by said speech analysis unit, before said speech analysis unit detects the vowel segment subsequent to the consonant segment.

14. A hearing-aid processing method, comprising:

operating a speech input unit to receive a speech signal from outside a speech signal from outside;

detecting a sound segment and a segment acoustically regarded as soundless from the speech signal received in said receiving, and detecting a consonant segment and a vowel segment within the detected sound segment;

temporally incrementing the consonant segment detected in said detecting, and temporally decrementing at least one of the vowel segment and the segment acoustically regarded as soundless and detected in said detecting; and adjusting an amount of time by which the consonant segment is to be incremented, based on temporal resolution information that indicates auditory temporal resolution of a user of said hearing-aid processing method, wherein in said temporally incrementing, the consonant segment detected in said detecting is incremented by the amount of time adjusted in said adjusting.

* * * * *